US008763625B1

(12) United States Patent
Carter

(10) Patent No.: US 8,763,625 B1
(45) Date of Patent: Jul. 1, 2014

(54) SIPHON PUMP TECHNOLOGY AND APPARATUSES

(71) Applicant: John T. Carter, Harrodsburg, KY (US)

(72) Inventor: John T. Carter, Harrodsburg, KY (US)

( * ) Notice: Subject to any disclaimer, the term of this patent is extended or adjusted under 35 U.S.C. 154(b) by 0 days.

(21) Appl. No.: 13/861,789

(22) Filed: Apr. 12, 2013

(51) Int. Cl.
*F04F 10/00* (2006.01)

(52) U.S. Cl.
USPC ..... 137/149; 137/131; 137/137; 137/143

(58) Field of Classification Search
USPC ..... 137/130, 131, 132, 133, 142, 146, 147, 137/148, 149, 151, 434–451, 136, 137, 143, 137/150.5; 4/344, 373; 222/204
See application file for complete search history.

(56) References Cited

U.S. PATENT DOCUMENTS 108,087 A * 10/1870 Averell ..... 137/148
125,559 A * 4/1872 Fox ..... 137/142
161,775 A * 4/1875 Gearing ..... 114/185
2,854,017 A * 9/1958 Spielvogel et al. ..... 137/149
4,364,228 A * 12/1982 Eller ..... 60/398
4,545,528 A * 10/1985 Perez ..... 239/1
5,358,000 A * 10/1994 O'Hair ..... 137/124
6,926,026 B1 * 8/2005 Burgoyne ..... 137/149

* cited by examiner

*Primary Examiner* — John K Fristoe, Jr.
*Assistant Examiner* — Matthew W Jellett

(57) ABSTRACT

Apparatuses to enable single-point valve control of siphons, siphon pumps, metering siphon pumps, and turbine siphon pumps include terminal anti-backflow valves, a system flow control valve, a metering chamber, a self-regulating chamber, and a siphon turbine. The terminal anti-backflow valves provide automatically closable systems without further priming after an initial prime. The system flow control valve consolidates functions for priming, pumping, dispensing, and siphon flow regulation to provide single-point valve control. The metering chamber operated by a single-point system flow control valve enables periodic dispensing of liquid above a supply source. The self-regulating chamber controls a single-point system flow control valve to regulate a metering chamber for periodic dispensing. The siphon turbine provided with terminal anti-backflow valves and regulated by a single-point system flow control valve enables hydropower production. Benefits include precision control, single-point operation, safety, new applications, energy savings, installations without power facilities, and a renewable clean energy technology.

3 Claims, 19 Drawing Sheets

SIPHON PUMP TECHNOLOGY AND APPARATUSES

A non-provisional utility patent application for an Improved Siphon Pump Technology and Apparatuses related to single-point valve control for closable siphon pump systems is submitted Pro Se by John T. Carter, a USA citizen born Nov. 3, 1939, residing at 643 Keenon Road, Harrodsburg, Ky., 40330-8619; contact via email (johntcarter@usa.com) or cell phone (859-325-3271).

BACKGROUND OF THE INVENTION

1. Field of the Invention

The field of the invention encompasses Class 137 for flowable materials, Sub-Class 123 for siphons, and Class 415 for rotary pumps and Sub-Class 80 for runners. The invention relates to improvements in owned U.S. Pat. No. 5,358,000 and related prior art for a siphon pump technology that includes system components and apparatuses comprising an inlet anti-backflow valve, a system flow control valve, a metering chamber, an automatic regulating chamber, and a turbine. Improvements benefit the safe and controlled transfer of liquids such as water, chemicals, petroleum-based fuels, bio-fuels, beverages, and food products to achieve energy efficiency in operations and applications, and energy production via applications in hydropower generation.

2. Description of the Related Art

Descriptions of prior art related to an improved siphon pump technology are based on U.S. Pat. No. 5,358,000, a registered copyright, a prototype flow control valve, and hydropower technologies. Each description presents state of the art, identified problems or issues, and solutions.

a. Prior Art—Siphon System

FIG. 1 illustrates the elements and configuration for a siphon system described in copyright registration 1960282. The system comprises a two-way system flow control valve 1 arranged between the open inlet of the first siphon conduit 2 and the second siphon conduit 3 having an anti-backflow valve 4 within the outlet. Opening and closing of the anti-backflow valve 4 responds automatically to opening and closing, respectively, of the control valve 1. Priming the system requires filling the system with liquid at the first siphon conduit 2 open inlet while holding the anti-backflow valve 4 at the same level. Once filled, the system flow control valve 1 is closed to retain prime in the system for operation, transport, or storage. Placing the inlet of the first siphon conduit 2 in the liquid supply source and opening the control valve 1 to start siphon flow automatically opens the anti-backflow valve 4 to self-prime the system by purging entrained air. Once primed, operation of the system control valve 1 permits automatic siphoning and precision control of system start, stop, restart, and variable flow for rapid, repeated and safe operations without further priming, providing the first siphon conduit 2 remains within the supply source to retain full-system prime.

The problems associated with this configuration include required self-priming to initially purge air for a continuous, controlled flow, and loss of prime in the first siphon conduit 2 once removed from the supply source. The siphon system described for FIG. 8 and presented in claim 1 resolves these problems by the addition of an anti-backflow valve 39 within the inlet of the first siphon conduit 2 to prevent the return of liquid to the supply source and maintain full-system prime to eliminate the need for self-priming. The improved siphon system will expand scalable applications in the controlled transfer of liquids without further priming for rapid, repeated and safe operations.

b. Prior Art—U.S. Pat. No. 5,358,000 Metering Siphon Pump

FIG. 2 illustrates the independent claim 1 configuration in U.S. Pat. No. 5,358,000 for a "Siphon Pump Having a Metering Chamber". The patent is a pioneering breakthrough to dispense liquids above the source, control flow, retain prime, and require less energy than powered pumps. The patent presents methodologies to successfully and economically pump liquid uphill for dispensing based on the siphon principle. Although the siphon principle has a theoretical limit of approximately 34 feet to pump liquid above the supply source, a more practical limit is 25 feet. However, arranging the systems in several tiers permits the next higher system to use the lower system as a supply source, extending the application of the siphon principle to pump liquid above the 25 foot limit; an advantage for applications in water management and hydropower.

The basic process involves first priming the system at the charging inlet 10, closing the system flow control valve 1 and then opening the air admitting valve 5 to dispense liquid into a destination container 6 from the metering chamber 7 via the anti-backflow valve 8 located above the supply source. Closing the air admitting valve 5 and opening the system flow control valve 1 permits siphon flow through the first 2 and second 3 siphon conduits and metering chamber 7 to purge newly introduced air and automatically prime the system for the next dispense-purge cycle. Proper operation requires an increase in the second siphon conduit 3 length to provide sufficient prime to restore the system for the next cycle. System stoppage is accomplished by closure of both the air admitting valve 5 and the system flow control valve 1; restart is automatic via opening of the system flow control valve 1.

Technical issues were identified that limit utility, make the system less effective, or even render the system inoperable. Independent claim 1 for U.S. Pat. No. 5,358,000 has deficiencies that include the omission of key elements, inclusion of unnecessary components, complexity of the metering chamber, and inadequate priming and control methodologies. Findings are listed by the original claim, associated technical issues and proposed solution:

(1). Claim 1: A siphon pump system for dispensing a predetermined quantity of water from a water supply source, . . . .

Issue: Supply source is limited to water; siphons pump any liquid.

Solution: Substitute liquid for water in Claims 1-5.

(2). Claim 1a: A destination container 6 for receiving water from the water supply source;

Issue: A destination container 6 is not a necessary element for siphon pump operation.

Solution: The destination container 6 may be eliminated in new claims.

(3). Claim 1b: A holding canister 7 including an air inlet valve 5 for allowing air to enter the system and an outlet check valve 8 for controlling the rate of flow of water from the holding canister 7 into the destination container 6, Issues: Separation of the air admitting valve 5 and the system flow control valve 1 limits control methodologies, and adds unnecessary complexity to the holding canister [metering chamber]; a critical control valve, omitted in the claims, controls the rate of flow, not the check (anti-backflow) valve 8 as specified.

Solution: Simplification of the holding canister [metering chamber] and system design with an improved multi-function system flow control valve apparatus, described for FIG. 9 and presented in claim 2, resolves the complexity and control issues.

(4). Claim 1e: A system flow control valve 1 positioned in the second siphon conduit 3 for controlling the flow of water through the first siphon conduit 2, the holding canister 7 [metering chamber], and the second siphon conduit 3; and Claim 1g: A flow control valve 9 in the second siphon conduit 3 upstream of the anti-backflow valve 4 for controlling flow of water through the first siphon conduit 2, the holding canister 7 [metering chamber], and the second siphon conduit 3;

Issue: Both valves perform the same function within the same conduit; a duplicate valve is unnecessary for siphon pump operation.

Solution: Eliminate duplicate flow control valve 1*g* 9 in the second siphon conduit 3.

(5). Claim 1h: A charging inlet 10 at an upper end of the holding canister 7 [metering chamber] for initially priming the siphon pump system;

Issue: Inclusion of the charging inlet 10 adds unnecessary complexity to the holding canister 7 [metering chamber].

Solution: Simplification of the holding canister [metering chamber], and an improved single-source system flow control valve apparatus, described for FIG. 9 and presented in claim 2, resolves the complexity and control issues.

(6). Claim 2: A siphon pump system in accordance with claim 1 including an anti-backflow valve positioned in the first siphon conduit 2 for preventing return of water within the system to the water supply source.

CRITICAL ISSUE: The anti-backflow valve was added as a dependent claim, not as an independent claim element. An anti-backflow valve is required in the stand-alone independent claim to prevent escape of liquid back to the supply source, and to retain liquid within the first siphon conduit 2 during all system operations. Absence of the anti-backflow valve renders the system inoperable as presented in U.S. Pat. No. 5,358,000 independent claim 1.

Solution: Include an anti-backflow valve as an element in the first siphon conduit inlet presented in Claims 1-5.

(7). Omitted Claim: a required control valve in the metering chamber 7 lower outlet was omitted in all U.S. Pat. No. 5,358,000 claims.

CRITICAL ISSUE: A control valve is required for closure of the holding canister [metering chamber] 7 during priming, and for regulation; liquid will escape from the metering chamber 7 during priming if not present, and regulation of the dispense-purge cycle depends upon adjustment of this valve. Absence of the control valve renders the system inoperable.

Solution: Include a lower outlet control valve as an element to the modified metering chamber in claims 2 and 3.

Issues associated with U.S. Pat. No. 5,358,000 and related prior art limit utility or render systems inoperable as originally claimed. The solutions described for FIG. 9 and presented in claim 2 attempt to expand utility for multiple applications, and improve system design and apparatuses for simplicity, control and functionality. Siphons are described as a gravity pumps, but are currently considered to have limited applications. Improvements will expand the potential for applications using the siphon principle as a power source to transfer liquids, dispense above the supply source, and contribute to the generation of hydropower.

c. Prior Art—U.S. Pat. No. 5,358,000 Automatic Timing Apparatus

FIG. 3 illustrates U.S. Pat. No. 5,358,000 dependent claim 13 for an automatic timing apparatus to control dispensing of liquids above the source from the holding canister [metering chamber] 7, automatically and self-sustaining without the aid of any powered device using a complex configuration of mechanical elements and valves for control. The basic process involves actuation of the air admitting valve 5 and system flow control valve 1 via control arms 11 and 12, respectively, responding to the holding canister [metering chamber] 7 flow filling a timing bucket 13 connected by a cable 14 and pulley 15 arrangement to a counterweight 16, and timing of the opening and closure of the air admitting 5 and flow control 1 valves controlled by a control valve 17 in the timing bucket 13 adjusted to release water at a rate to ensure full system prime, and that the air admitting valve 5 and system flow control valve 1 are not open at the same time to prevent system collapse.

(1) Claim 13: A siphon pump in accordance with claim 1 including timing apparatus for automatically periodically controlling system siphon flow and for admitting air into the holding canister [metering chamber] for releasing water contained in the holding canister [metering chamber], the timing apparatus including air admitting valve actuation means including a pulley member and a cable passing over the pulley member and having a first end engageable with and supporting a timing bucket to receive water from the holding canister [metering chamber], and a second end supporting a counterweight having a predetermined weight, the cable including a first cable clamp member engageable with a control arm connected with and operative to control opening and closing of the system flow control valve, wherein the system flow control valve is closed when the timing bucket is empty of water and the system flow control valve is open when the timing bucket contains sufficient water to exceed the weight of the counterweight, the cable including a second cable clamp member engageable with a control arm connected with and operative to control opening and closing of the air admitting valve, wherein the air admitting valve is open when the timing bucket is empty of water and the air admitting valve is closed when the timing bucket contains sufficient water to exceed the weight of the counterweight, and wherein the timing bucket includes an outlet flow control valve to permit flow of water from the timing bucket into the destination container at a predetermined flow rate.

Issue: The timing apparatus requires a variety of antiquated mechanical and magnetic devices, is very complex, oversized, and restricted to separate two-way valves, and is not commercially feasible.

Solution: A complete re-design of the apparatus is necessary to reduce size, complexity, number and type of components for a practical, dependable, and commercially viable system. The description for FIG. 10 presented in claim 3 provides an improved automatic regulating chamber apparatus with linkage to the multi-function system flow control valve apparatus, ensuring that the control valve and the air admitting valve are not open at the same time during the dispensing and purging process, and ensuring the elapse of sufficient time between dispensing and purging to restore system flow.

d. Prior Art—Prototype System Control Valve

FIG. 4 illustrates a prototype system flow control valve 18 that combines the functions of system flow control and air admittance into a single manually operated four-way piston valve 18. The prototype valve 18 replaces the air admitting valve 5 of the holding canister [metering chamber] and the system flow control valve 1. The priming inlet 26 of the holding canister [metering chamber] 7 is not altered. The prototype comprises a four-way body 19 having a top inlet 20 for air admittance and valve stem 21 access and travel, a lower outlet 22 for admitting air into the metering chamber 7, a next-lower inlet 23 for siphon flow from the metering chamber 7, and a bottom outlet 24 for out-going siphon flow. The valve stem 21 comprises three sets of valve sections 25 to separate air flow and siphon flow by positioning the valves to permit air flow into the metering chamber 7 and simultaneously restrict siphon flow through the system, or to restrict air flow into the metering chamber 7 and simultaneously permit siphon flow through the system.

The problems associated with the prototype are massive weight and size, manual operation only, a limit of two functions, complex valve arrangements for air and liquid flow, and retention of holding chamber [metering chamber] complexity. The solution relies on the discovery that air and siphon flow could use the same conduit, but in opposite directions, because each process is conducted separately, and alternately. Therefore, the air admitting valve section 25 and conduit 22 may be eliminated by combining the air admittance and siphon flow functions via the siphon inlet conduit 23. The improved system flow control valve apparatus resolves the issues for air control, siphon flow control, dispensing, and priming as described for FIGS. 10 and 11 and presented in claims 3 and 4 with a reduction in size, weight, and complexity. The improvement maintains air flow separate from siphon flow during the dispense-purge cycle, a critical requirement to prevent system collapse, and consolidates all system functions for single-source operation.

e. Prior Art—Hydropower Technologies

FIGS. 5, 6 and 7 illustrate current hydropower technologies for generating power from streams, reservoirs, and pumped storage ponds. Proposed improvements and apparatuses in siphon pump technology described herein contribute to energy production via turbine siphon pump systems, siphon pump intakes, and metering siphon pumps for pumped storage.

FIG. 5 illustrates a siphon turbine represented by the "Variable Speed Siphon Propeller Turbine" in operation by Derwent Hydro in Derbyshire, United Kingdom. The siphon turbine is located at a small dam 27 on a stream, and shown less the mechanical and electrical gear. Priming is achieved using a suction pump to pull upstream flow 28 into the intake 29 until it flows through the turbine 30 and outlet 31 sufficient to establish a continuous siphon flow downstream 32. The operating speed of the turbine is changed by a variable-speed control system. The system is shut down by opening a valve 33 in the siphon conduit to break the siphon. The turbine consists of a bladed shaft 34 enclosed within the turbine housing 30 for connection to hydropower generating gear.

The problems associated with the siphon turbine design include limited scalability and flow control methodology, required priming after system shut down, and proximity to the water source risking functionality and/or flood damage. A solution is described for FIG. 12 and presented in claim 5 to incorporate a turbine into a siphon pump system having an improved system flow control valve apparatus, an anti-backflow valve in the first siphon conduit inlet, and an anti-backflow valve in the second siphon conduit outlet. The system flow control apparatus features single-source system control for priming and instant response for start, stop, restart, and variable flow necessary for controlled hydropower generation. System design with anti-backflow valves at inlet and outlet terminuses maintains full-system prime even at shut down. Placement of both the control valve and turbine at the crown permits access for operation, maintenance and protection from flooding up to 25 feet above the supply source, and at a safe distance from the supply source. Since power generation is determined by flow control, the turbine siphon pump system will replace the priming pump, variable-speed control system, and siphon-breaking valve. Importantly, the improved system may be scaled from portable low-power low-head applications on streams to fixed high-power high-head facilities at reservoirs.

FIG. 6 illustrates a typical siphon intake or penstock at a hydropower generating facility represented by U.S. Pat. No. 4,629,904 for a micro-hydroelectric power plant. The turbine is located below the supply source 28 at a reservoir dam 27 with a siphon penstock inlet 29 upstream 28 and system outlet 31 downstream 32. Opening a siphon-breaking valve 33 at the siphon crown will shut the system down, while speed control and priming require separate powered equipment.

The problems associated with the siphon penstock design include lack of prime retention, limited flow control, and required priming at system shut down. The solution is described for FIG. 9 and presented in claim 2 for a siphon pump system having an improved system flow control valve apparatus. The anti-backflow valve at the second siphon outlet may be directly connected to the turbine input, with single-source control for priming and instant response for start, stop, restart, and variable flow. System design with anti-backflow valves at inlet and outlet terminuses maintains full-system prime even at shut down for instant restart response. The improved system flow control valve apparatus may be located up to 25 feet above the supply source, and at a safe distance from the supply source for ease of operation, maintenance, and protection from flooding. Since power generation is determined by flow control, the improved turbine siphon pump system will replace the priming pump, turbine speed control system, and siphon-breaking valve.

FIG. 7 illustrates a typical hydropower generating facility having a pumped storage system represented by the TVA Raccoon Mountain Pumped Storage Plant located on the Tennessee River near Chattanooga, Tenn. During low demand periods, water is pumped from a stream or reservoir 35, into a bi-directional conduit 36, through the bi-directional turbine 30, and upward through a bi-directional conduit 37 to a hilltop reservoir 38 to create a supply source. During periods of high demand, water is released in the opposite direction to drive the turbine 30 at a lower elevation to generate hydropower.

The problem with pumped storage systems is the electrical energy required to pump the water to a higher elevation, and limited to periods when demand is low. Solutions to elevate water into a reservoir are described for FIGS. 10 and 11, and presented in claims 3 and 4 for metering siphon pump systems. By arranging metering siphon pumps in a tiered fashion using the next-lowest system as a supply source, water may be pumped to elevations exceeding the normal 25 foot limitation for siphon technology separate from any generating equipment, and without any restrictions due to demand periods.

SUMMARY OF THE INVENTION

An Improved Siphon Pump Technology and Apparatuses invention encompasses Class 137, Sub-Class 123, Class 415, and Sub-Class 80. Improvements for the safe and controlled transfer of liquids includes system components and apparatuses comprising an inlet anti-backflow valve, a system flow control valve, a metering chamber, an automatic regulating chamber, and a turbine. The closed siphon pump technology has in common the unique combination of a control valve separating anti-backflow valves at the system inlet and outlet for precision flow control, prime retention, and automatic siphoning. Prior art includes a siphon system, U.S. Pat. No. 5,358,000 having a metering chamber and an automatic timing apparatus, a prototype system flow control valve, and hydropower technologies. The prior art has problems related to self-priming, retention of prime, flow control, and design complexity. Technical issues identified in U.S. Pat. No. 5,358,000 render the metering siphon pump system inoperable. Deficiencies in the patent include the omission of key elements, inclusion of unnecessary components, complexity of the metering chamber, and inadequate priming and control methodologies. The automatic timing apparatus to control metering involves a complex arrangement of multiple valves, mechanical systems, and magnetic devices that rely on critical timing for operation, limiting the feasibility for commercial applications. The prototype system flow control valve has problems associated with massive weight and size, limited control functions, complexity of design and operation, and manual operation only. Hydropower technologies have limited scalability, risk of functionality and/or flood damage due to proximity of supply source, lack of prime retention, limited flow control, and required priming at system shut down.

Improvements focus on system design and control apparatuses. Claim 1 (FIG. 8) specifies a siphon system having an inlet anti-backflow valve to retain full-system prime. Claim 2 (FIG. 9) specifies a siphon pump system having an inlet anti-backflow valve to retain full-system prime, and a system flow control valve apparatus for pumping, priming and control of start, stop, restart, and variable flow. Claim 3 (FIG. 10) specifies a siphon pump system in accordance with claim 2 having a metering chamber apparatus for dispensing. Claim 4 (FIG. 11) specifies a siphon pump system in accordance with claim 3 having an automatic regulating chamber apparatus for actuation of the system flow control valve apparatus to control periodic self-sustained dispensing from the metering chamber. Claim 5 (FIG. 12) specifies a siphon pump system in accordance with claim 2 having a turbine for connection to mechanical and electrical hydropower generating facilities. Applications of the improved siphon pump technology will benefit food production, water management, and energy development.

BRIEF DESCRIPTION OF THE DRAWINGS

FIG. 1: Prior Art Siphon System Having a Control Valve and Outlet Anti-Backflow Valve.

FIG. 2: Prior Art U.S. Pat. No. 5,358,000 Independent Claim 1 for a Siphon Pump Having a Metering Chamber.

FIG. 3: Prior Art U.S. Pat. No. 5,358,000 Dependent Claim 13 for an Automatic Timing Apparatus for a Siphon Pump Having a Metering Chamber.

FIG. 4: Prior Art Prototype System Flow Control Valve for a Siphon Pump Having a Metering Chamber.

FIG. 5: A Commercial Siphon Turbine System Mounted Above the Supply Source for Generating Hydropower.

FIG. 6: A Typical Siphon Intake for a Turbine System Mounted Below the Supply Source for Generating Hydropower.

FIG. 7: A Typical Pumped Storage System Providing a Supply Source for Generating Hydropower.

FIG. 8: An Improved Siphon System Having an Inlet Anti-backflow Valve for Full-Time Prime Retention.

FIG. 9: A Siphon Pump System Having an Improved System Flow Control Valve Apparatus for Priming and Precision Flow Control.

FIG. 10: A Siphon Pump System Having an Improved Metering Chamber and an Improved System Flow Control Valve Apparatus for Dispensing a Measured Quantity of Liquid above the Supply Source.

FIG. 11: A Siphon Pump System Having an Improved Regulating Chamber Apparatus for a Siphon Pump Having a Metering Chamber.

FIG. 12: A Siphon Pump System Having a Turbine and Improved System Flow Control Valve Apparatus for Generating Hydropower.

DETAILED DESCRIPTION OF THE INVENTION

FIGS. 8 through 12 illustrate the following detailed descriptions for an Improved Siphon Pump Technology and Apparatuses presented in Claims 1 through 5, respectively.

Figure 8:
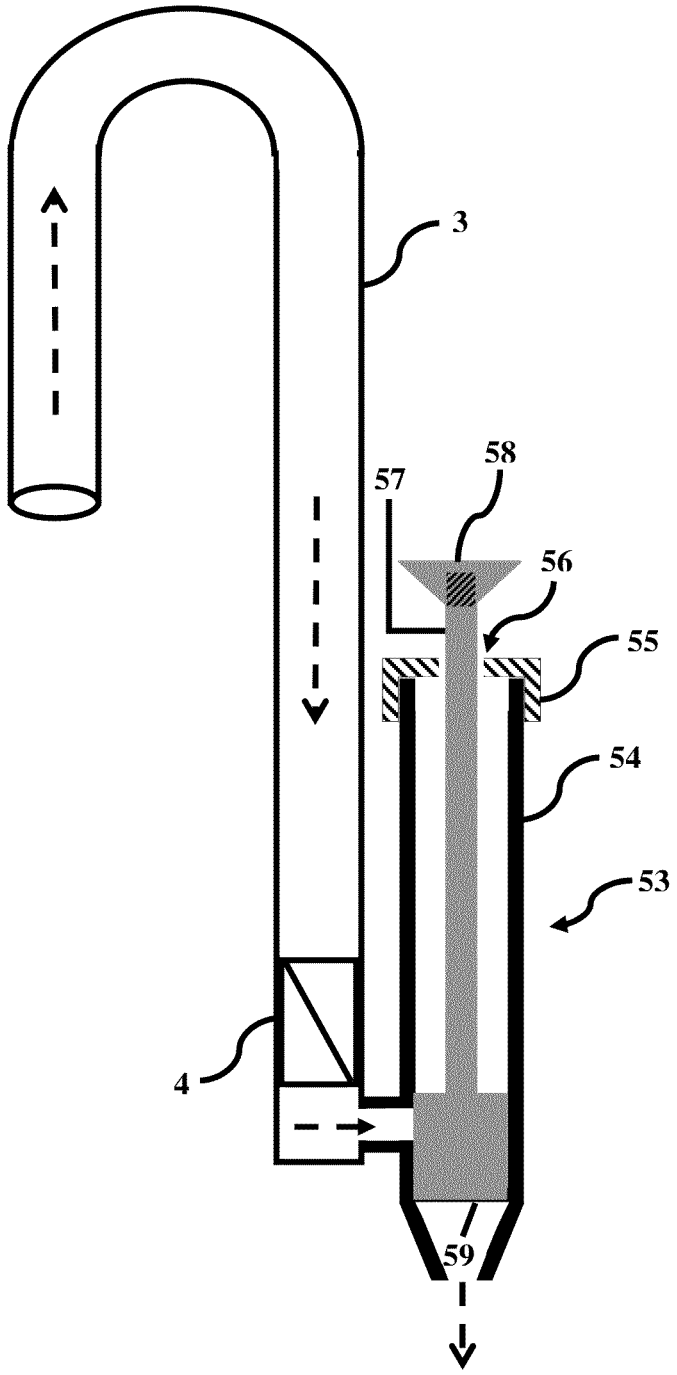
FIGS. 8-12 illustrate claim embodiments. Broken directional arrows indicate liquid flow; dotted directional arrows indicate air flow.

FIG. 8 illustrates an improved siphon system having an anti-backflow valve 39 at the first siphon conduit 2 inlet for full-time prime retention to maintain system readiness. The system comprises a two-way system flow control valve 1 arranged between the first siphon conduit 2 having an anti-backflow valve 39 within the inlet, and a second siphon conduit 3 having an anti-backflow valve 4 within the outlet. Opening and closing of the inlet 39 and outlet 4 anti-backflow valves automatically responds to the opening and closing of the two-way system flow control valve 1. Priming is accomplished by placing the inlet of the first siphon conduit 2 in a liquid supply source and operating a suction device to withdraw air via the second siphon conduit 3 outlet until the system is filled with liquid, or vertically moving the siphon conduit inlet 2 up and down until the system is filled with liquid. Once filled, closure of the system flow control valve 1 retains prime in both the first 2 and second 3 siphon conduits for operation, transport, or storage. System flow control valve 1 operation permits automatic siphoning and precision control of start, stop, restart and variable flow for rapid, repeated and safe operations without further priming. The improved siphon pump system offers expanded applications in the controlled transfer of liquids.

Figure 9:
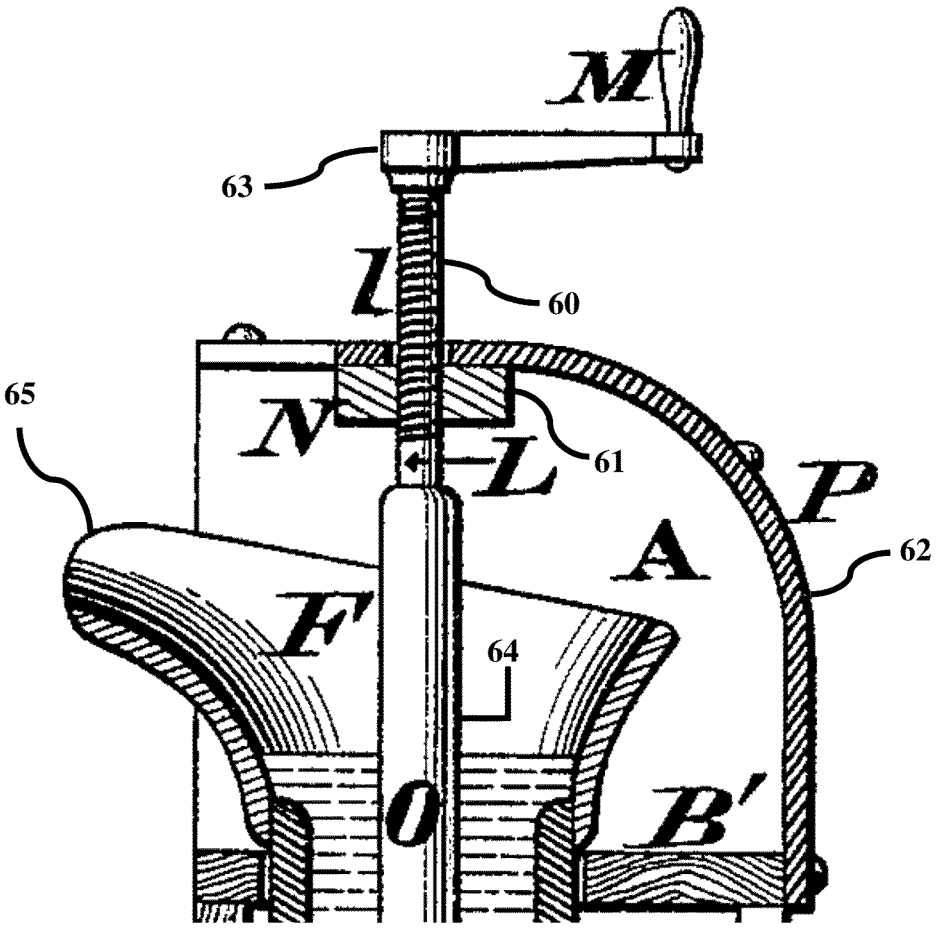

FIG. 9 illustrates a siphon pump system having an improved system flow control valve apparatus 40 for priming and the precision transfer of liquids, including an anti-backflow valve 39 in the first siphon conduit 2 inlet to prevent liquid from returning to the supply source for prime retention. The system flow control valve apparatus 40 is arranged between the first 2 and second 3 siphon conduits for automatic siphoning, pumping, priming, and control of start, stop, restart, and variable siphon flow. The apparatus 40 includes a three-way valve body having an upper body inlet conduit for valve stem assembly 41 access and travel, a lower body outlet conduit inline with the upper body inlet for valve stem assembly 41 travel and communicating with the inlet of the second siphon conduit 3 for siphon flow, and a body conduit perpendicular to the upper and lower body conduits, and communicating with the outlet of the first siphon conduit 2 for siphon flow. A perforated valve cap 42 having a threaded central opening for accepting and guiding the valve stem assembly 41 is positioned at the inlet of the upper body conduit. The valve stem assembly 41 comprises a shaft threaded at the upper end for connection to optional actuator devices, such as a handle, and engagement of the threaded central opening in the valve cap 42 for rotary control; an upper valve section 43 to prevent entry of air and aid priming; and a lower valve section 44 to control rate of siphon flow and aid priming. Removal of the valve cap 42 will permit alternate means to actuate the valve stem assembly 41. The system flow control valve apparatus 40 also permits pumping of liquids above the supply source by repeated plunging of the valve stem assembly 41 via manual, mechanical, electro-mechanical, pneumatic, or other means of actuation.

To begin operation, the system is primed by upwardly dis-engaging the valve stem assembly 41 from the valve cap 42 and plunging the valve stem assembly 41 until siphon flow is established. The valve stem assembly 41 is then re-engaged with the valve cap 42 to control rate of siphon flow by rotating the valve stem assembly 41 to position the lower valve section 44 for desired flow or stoppage; the upper valve section 43 prevents entry of air. Inclusion of an anti-backflow valve in the first siphon conduit 2 inlet in combination with the anti-backflow valve 4 at the second siphon conduit 3 outlet permits priming, and full-system retention of prime for automatic restart of siphon flow without additional priming. Prime retention provided by combination of anti-backflow valves and the improved system flow control valve apparatus 40 allows the operator to shut off siphon flow for transport, storage, or intermittent operation, and remain ready for the next operation. The precision siphon pump system has energy efficient applications in food production and water management, and as a controllable siphon intake for hydropower generation.

Figure 10:
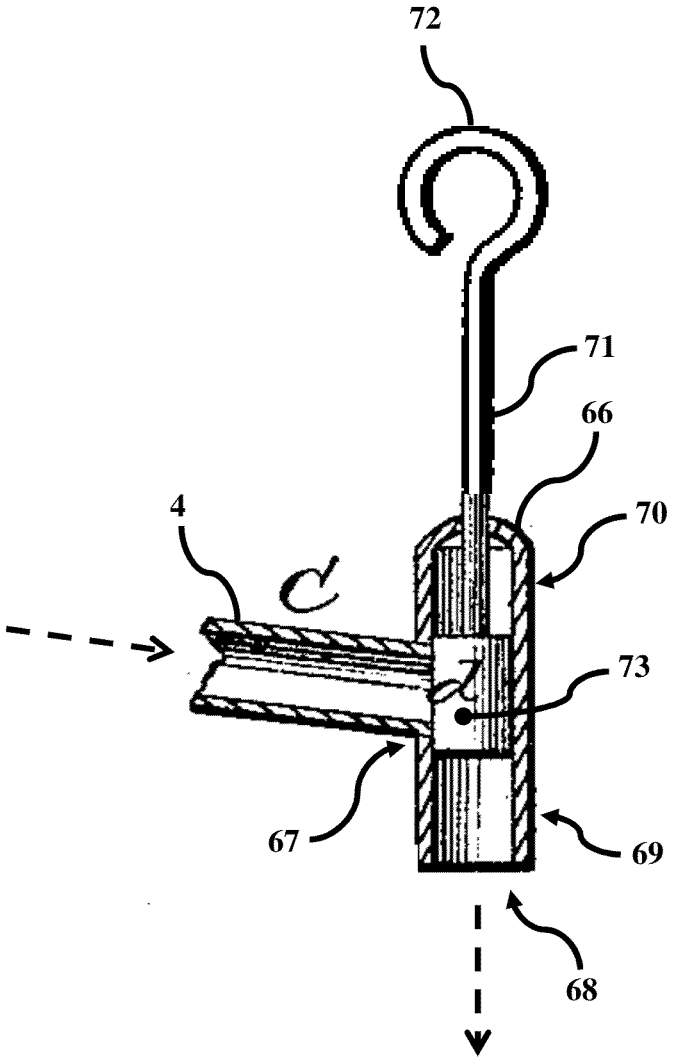

FIG. 10 illustrates a siphon pump system in combination with FIG. 9 and having an improved metering chamber 7 for dispensing a measured quantity of liquid above the supply source. Siphon flow begins at the anti-backflow valve 39 within a liquid supply source and through the first siphon conduit 2, the metering chamber 7, an improved system flow control valve apparatus 40, a second siphon conduit 3, and an anti-backflow valve 4 extending to an elevation below the liquid supply source sufficient to establish siphon flow.

The metering chamber 7 is positioned within the first siphon conduit 2 and above the liquid supply source for holding and dispensing a measured quantity of liquid, and includes an upper inlet communicating with the first siphon conduit 2 outlet for siphon flow entry to fill the metering chamber 7, an upper outlet communicating with the second siphon conduit 3 inlet for system siphon flow to exit the metering chamber 7, a lower outlet for dispensing above the supply source from the metering chamber 7, a flow control valve 48 communicating with the lower outlet of the metering chamber 7 for regulating metering chamber flow and priming the system, and an anti-backflow valve 8 communicating with the lower outlet via a flow control valve 48 for automatically dispensing from the metering chamber 7 when the upper valve section 43 of the improved system flow control valve apparatus 40 is open.

An improved system flow control valve apparatus 40 is arranged between the first 2 and second 3 siphon conduits for priming the conduits and metering chamber 7, admitting air for automatically dispensing from the metering chamber 7, and system control of start, stop, restart, variable siphon flow, and automatic siphoning. The improved system flow control valve apparatus 40 includes a three-way valve body having an upper valve body inlet conduit for admitting air and valve stem assembly 41 access and travel, a lower valve body outlet conduit inline with the upper valve body inlet for valve stem assembly 41 travel and communicating with the inlet of the second siphon conduit 3 for siphon flow, and a mid valve body conduit perpendicular to the upper and lower valve body conduits communicating with the outlet of the first siphon conduit 2 for siphon flow from the metering chamber 7 and alternately admitting air in the opposite direction for dispensing. A perforated valve cap 42 is located at the inlet of the upper valve body conduit and having a threaded central opening for engaging and guiding the valve stem assembly 41, and admitting air through the perforated valve cap 42 for dispensing. The valve stem is threaded at the upper extremity for actuator connectivity and engaging the valve cap 42, and includes an upper valve section 43 to control air admittance and aid priming, and a lower valve section 44 to control siphon flow and also aid priming. Selective positioning of the valve stein assembly 41 maintains air admittance separate from siphon flow to prevent siphon collapse, and controls siphon start, stop, restart, variable siphon flow, and automatic siphoning.

Priming is an initial operation followed by cycles of dispensing and purging. Priming requires upwardly disengaging the valve stem assembly 41 from the perforated valve cap 42 and plunging the valve stem assembly 41 until siphon flow is established, then downwardly re-engaging the valve stem assembly 41 with the valve cap 42 while the metering chamber 7 and siphon system are filling. Once filled and siphon flow is continuous, rotation of the valve stem assembly 41 will position the valve sections to stop siphon flow, dispense, or purge to restore system siphon flow. Dispensing from the metering chamber 7 is controlled by rotation of the valve stem assembly 41 to open the upper valve body conduit with upper valve section 43 to admit air for dispensing via the mid valve body conduit and metering chamber 7 upper outlet in a direction opposite to normal siphon flow, while simultaneously closing the lower valve body conduit with lower valve section 44 will stop siphon flow to retain prime for the next operation of purging. Purging of entrained air introduced during dispensing requires rotation of the valve stem assembly 41 to close the upper valve body conduit with valve section 43 to stop air admittance and dispensing, while simultaneous opening the lower valve body conduit with lower valve section 44 to automatically start siphon flow to purge the system of entrained air and self-prime the system for the next dispense-purge cycle. Stoppage of the system involves rotation of the valve stem assembly 41 to close the upper valve body conduit with upper valve section 43, and also close the lower valve body conduit with lower valve section 44, while retaining full-system prime for future dispense-purge cycles. Successful dispense-purge cycles depend upon the volume of liquid in the second siphon conduit 3 sufficiently adequate to completely purge entrained air and establish system siphon flow. Optionally, the valve cap 42 may be disengaged to operate the improved system flow control valve apparatus 40 by alternate means and or in a linear mode. Applications efficiently provide a supply source for food production and water supplies, and supply elevated pumped storage ponds which contribute to hydropower generation.

Figure 11:
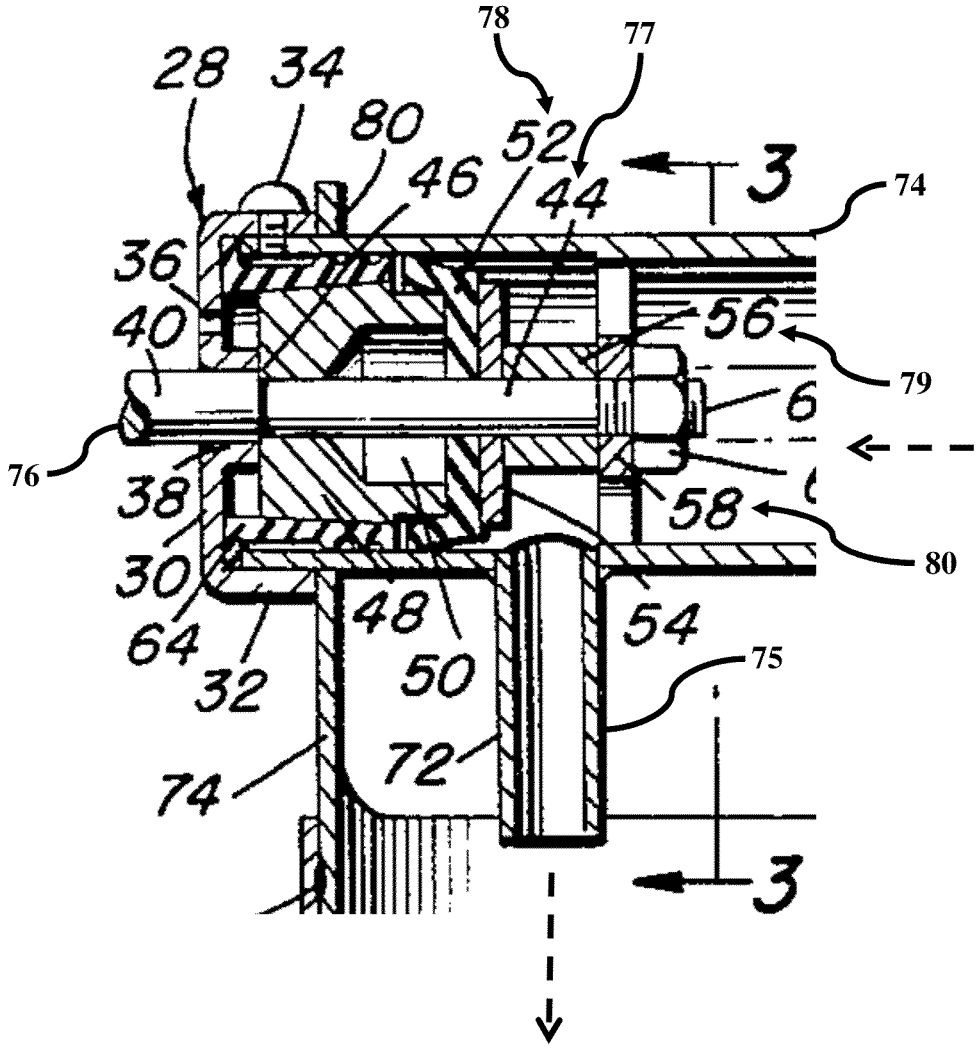

FIG. 11 illustrates a siphon pump system in combination with FIG. 10 and including an improved automatic regulating chamber 49 to control sustained periodic dispensing from the metering chamber 7. The primary function is energy-free actuation of the improved system flow control valve apparatus 40 for dispense-purge cycles. Elements associated with the process include a regulating chamber 50 having a flow control valve 51, a float linkage assembly 52 connected to the valve stem assembly 41, and a conduit 53 connecting to the metering chamber 7 flow control valve 48, an anti-backflow valve 8, and a metering chamber control valve 48. The valve cap 42 is removed for actuation control to allow linear travel of the valve stem assembly 41, which is connected to the automatic regulating chamber linkage 52.

Timing for each dispense-purge cycle is regulated by adjusting flow control valve 48 to release contents of the metering chamber 7 to fill the regulating chamber 50, and adjusting flow control valve 51 to release contents of the regulating chamber 50 within an adequate period of time to purge and restore siphon flow to prevent siphon collapse. Once the system is primed, vertical movement of the valve stem assembly 41 actuated by the float linkage 52 will position the upper 43 and lower 44 valve sections for dispensing and purging. Dispensing from the metering chamber 7 is controlled by downward movement of the valve stem assembly 41 actuated by the float linkage 52 to open the upper valve section 43 to admit air for dispensing. Air enters the mid-valve body conduit and through the metering chamber 7 upper outlet in a direction opposite to normal siphon flow. Simultaneously, the lower valve body conduit is closed via lower valve section 44 to stop siphon flow and retain prime for subsequent purging. Entrained air introduced during dispensing requires purging with upward movement of the valve stem assembly 41 via the float linkage 52 to close the upper valve section 43 to stop air admittance and dispensing. Simultaneous opening the lower valve section 44 to automatically start siphon flow will purge the system of entrained air and prepare the system for the next dispense-purge cycle. System stoppage involves positioning the valve stem assembly 41 to close the upper 43 and lower 44 valve sections via closure of the automatic regulation chamber 50 outlet valve 51 to maintain full-system prime for future dispense-purge cycles.

These operations complete one dispense-purge cycle; repeated cycles automatically continue to dispense a measured quantity of liquid above the supply source from the metering chamber 7 without the aid of any powered device, and alternately release a larger measure of siphon flow below the supply source from the second siphon conduit 3 outlet. Successful dispense-purge cycles depend upon the volume of liquid in the second siphon conduit 3 adequate to completely purge air and establish system siphon flow for subsequent dispensing. Applications are the same for the metering siphon pump system, but adds the special feature of energy-free self-sustained repeated dispensing above the supply source.

Figure 12:
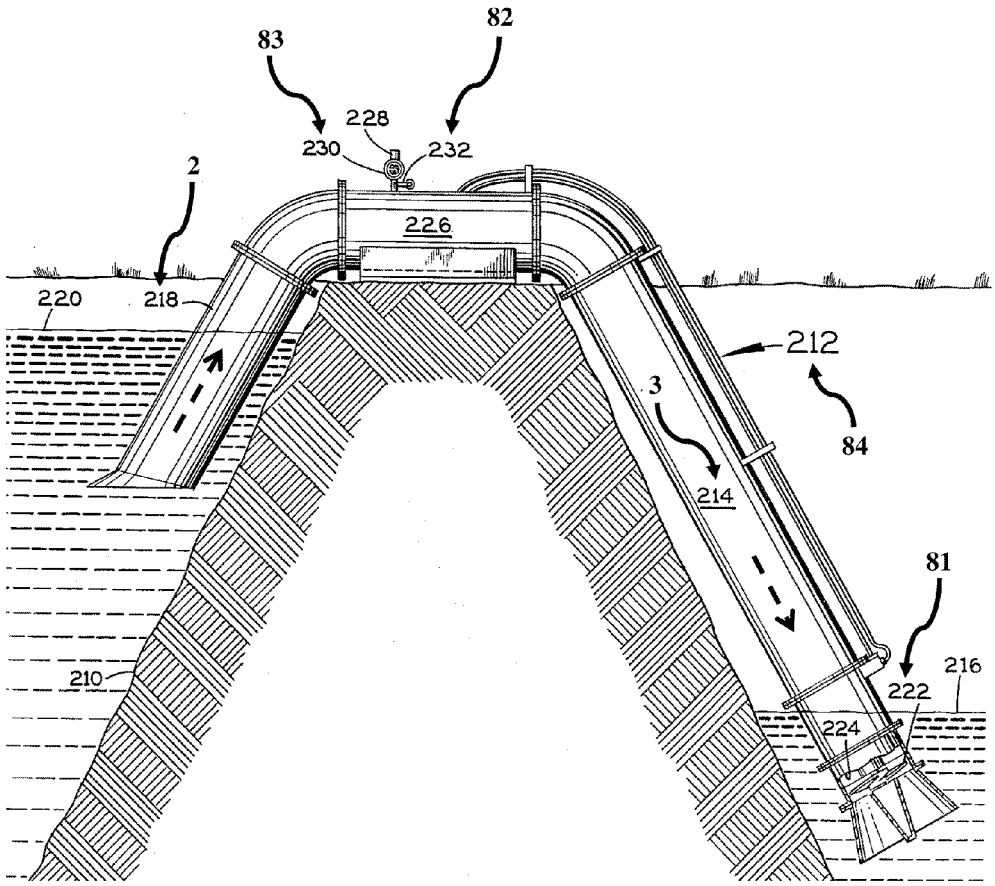
Figure 13:
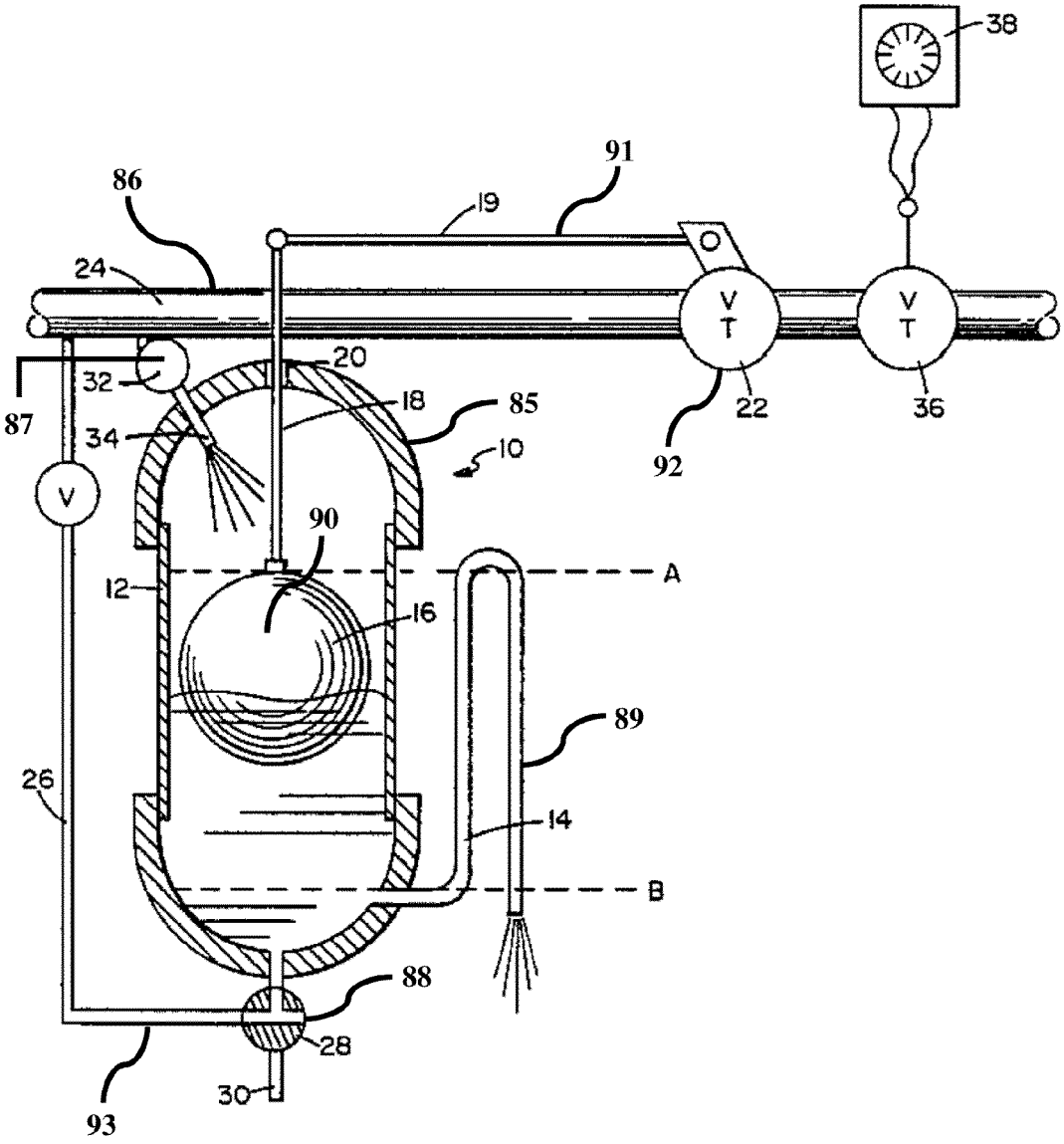
Figure 14:
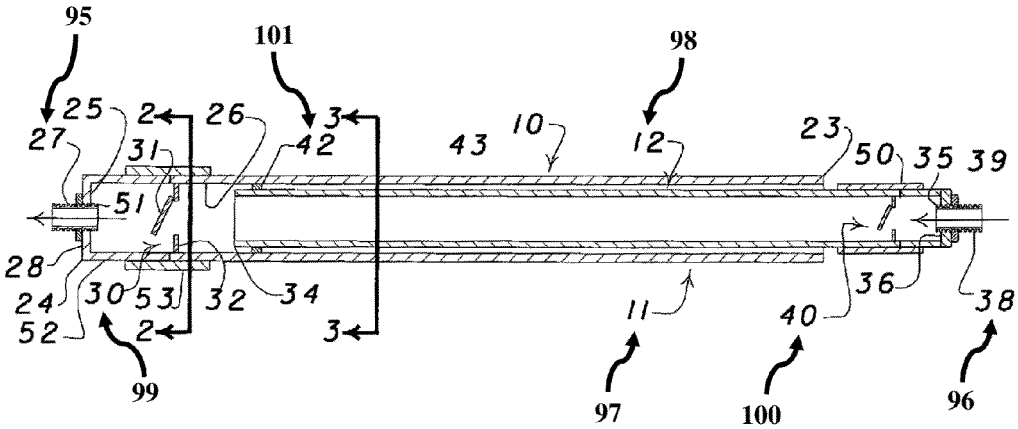
Figure 15:
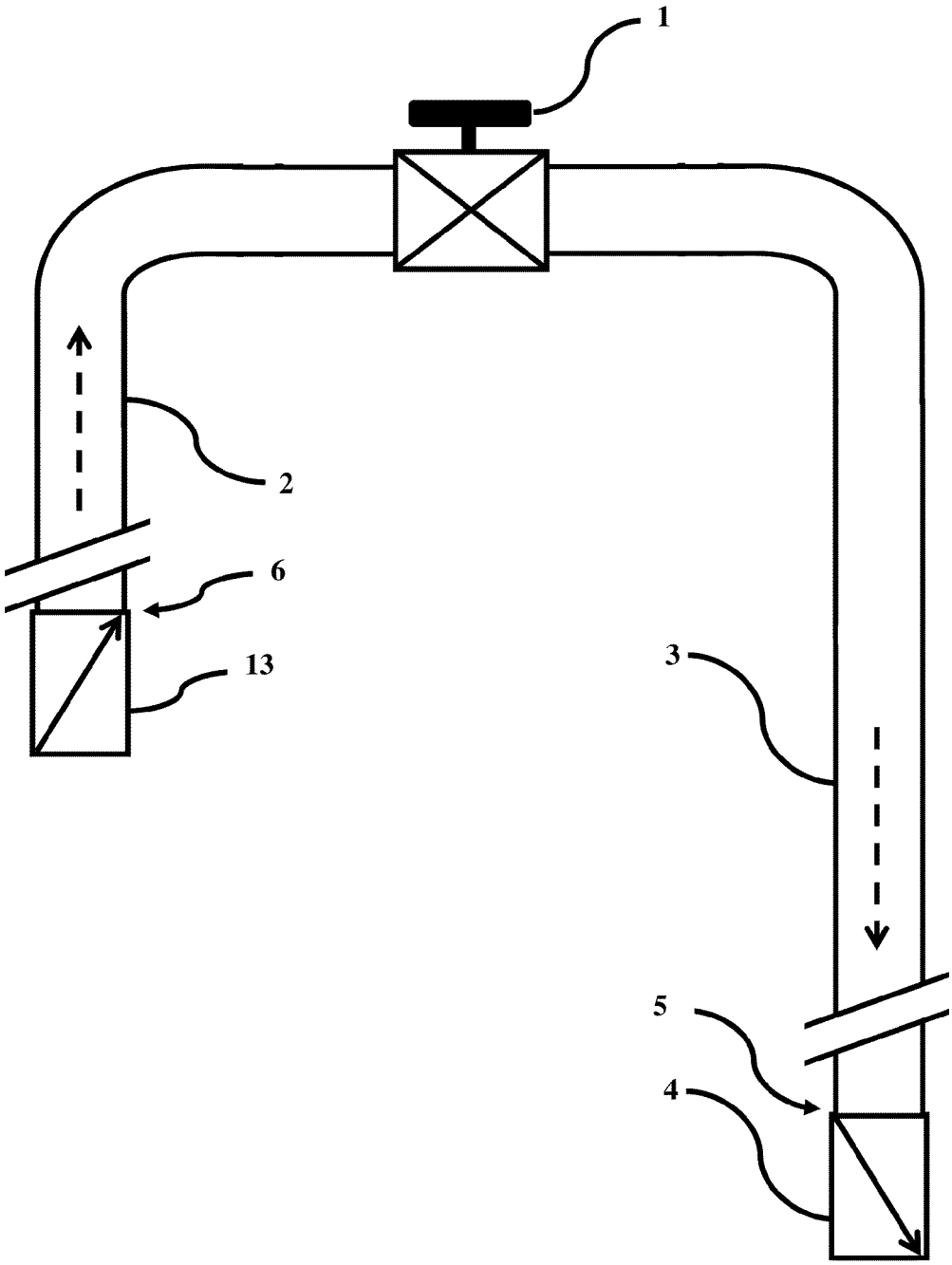
Figure 16:
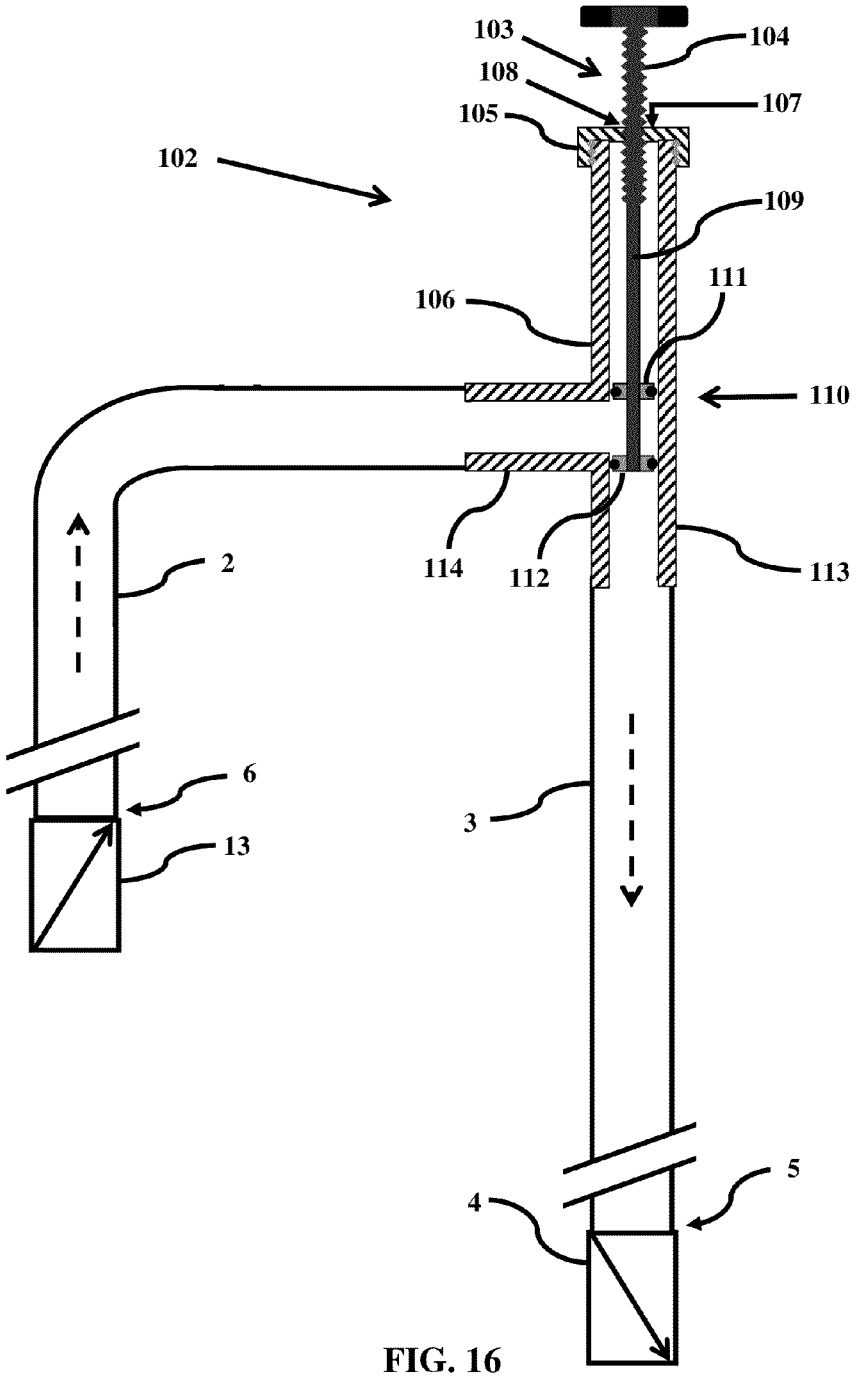
Figure 17:
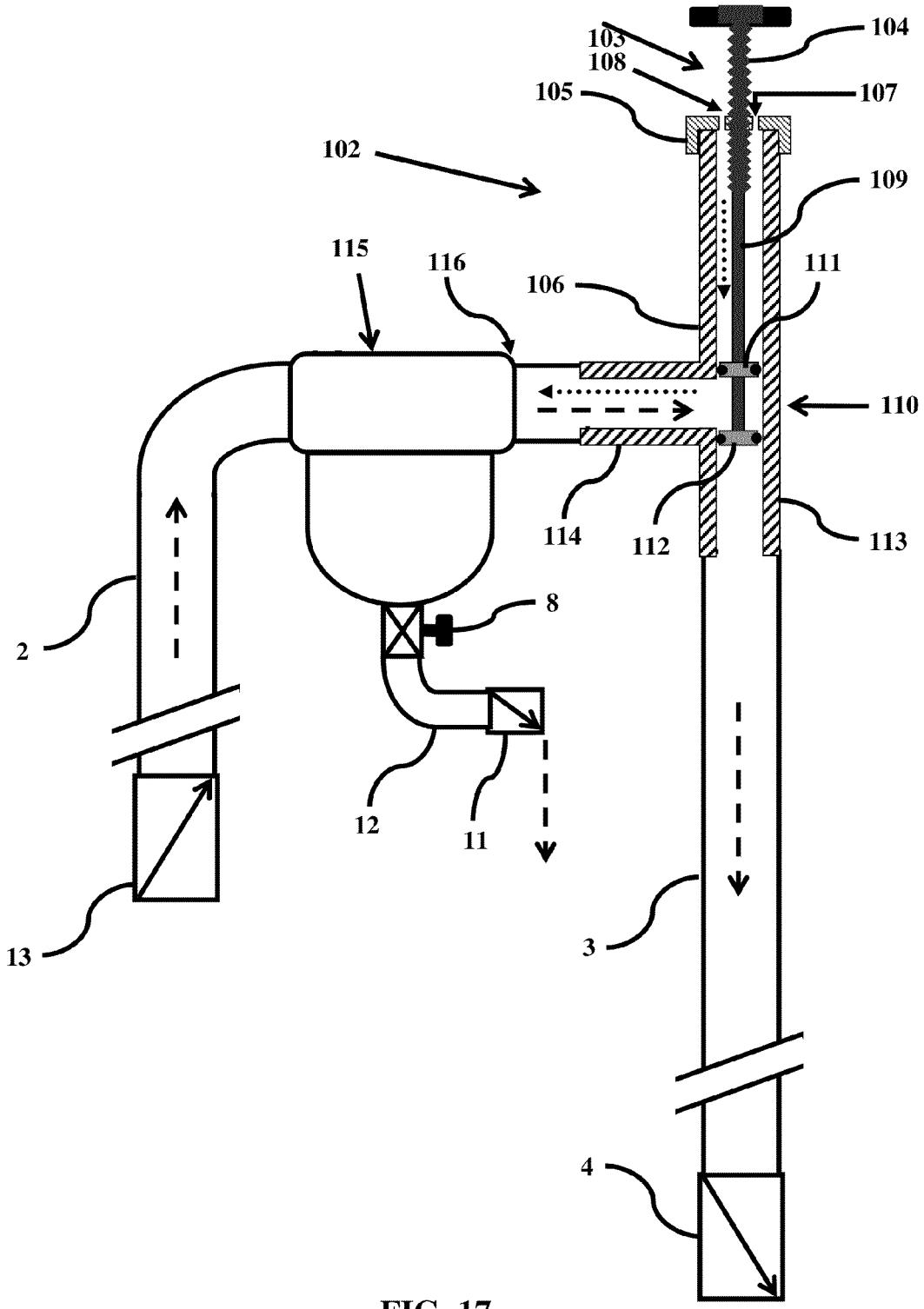
Figure 18:
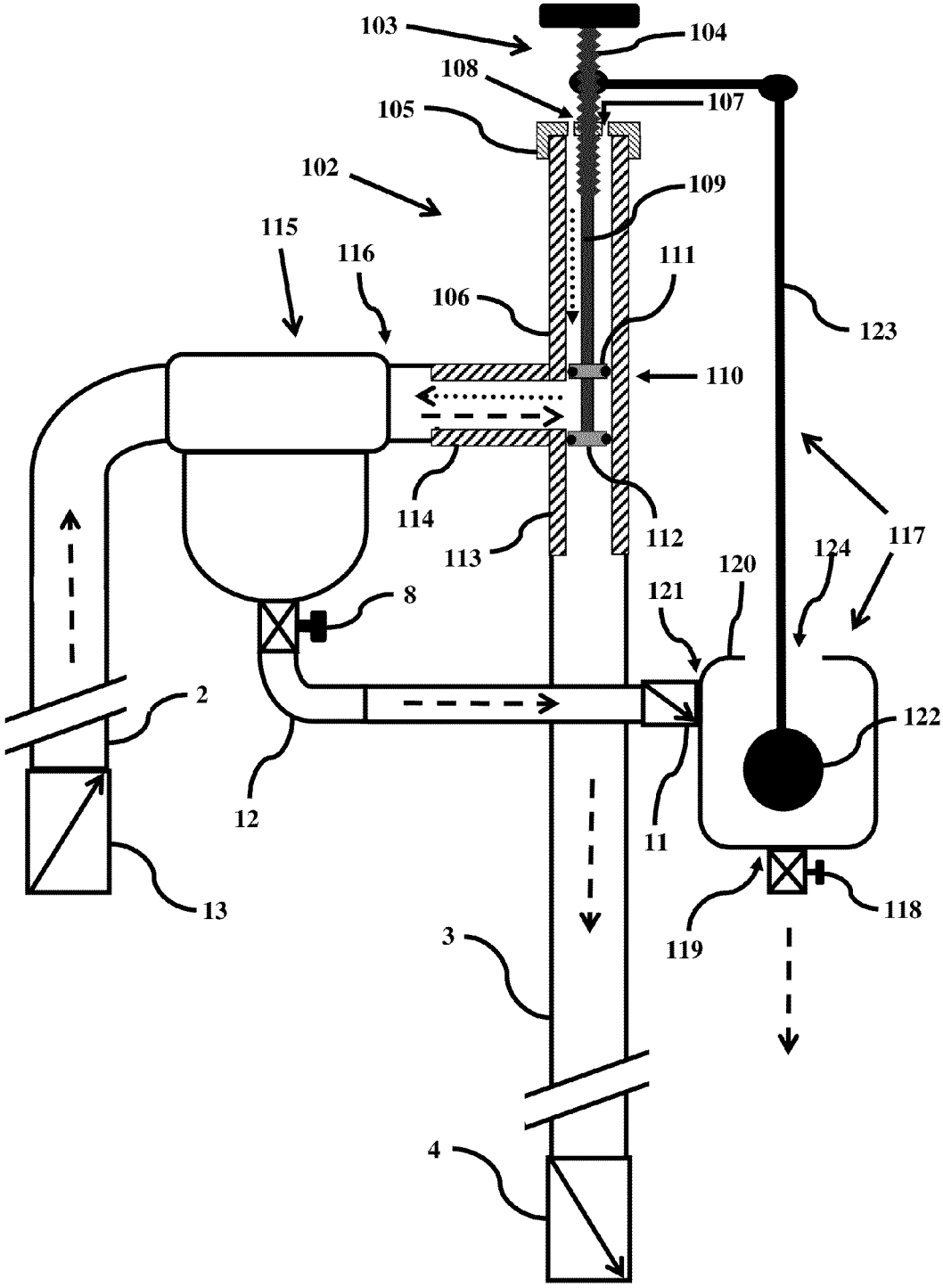
Figure 19:
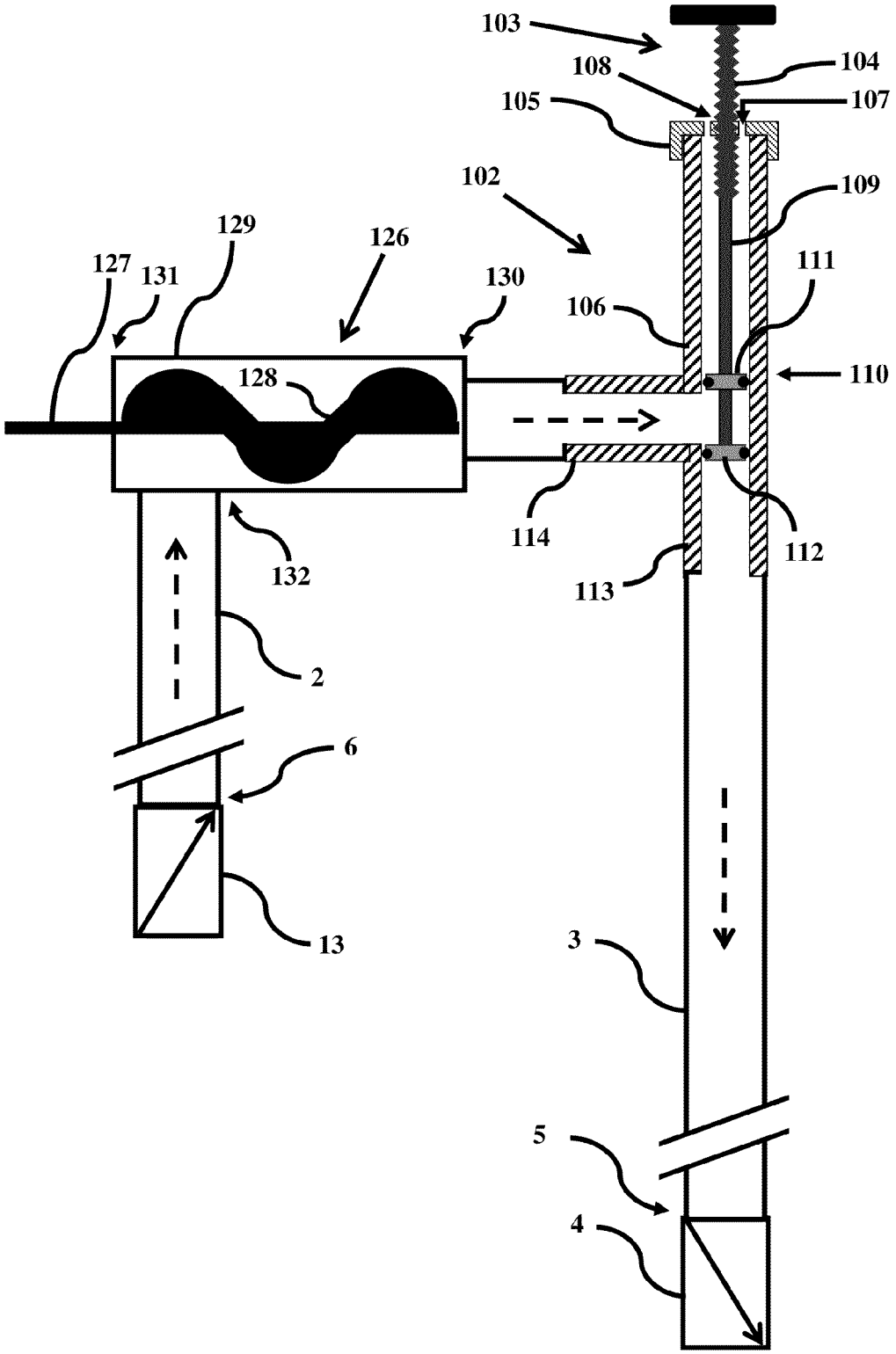
Figure 1:
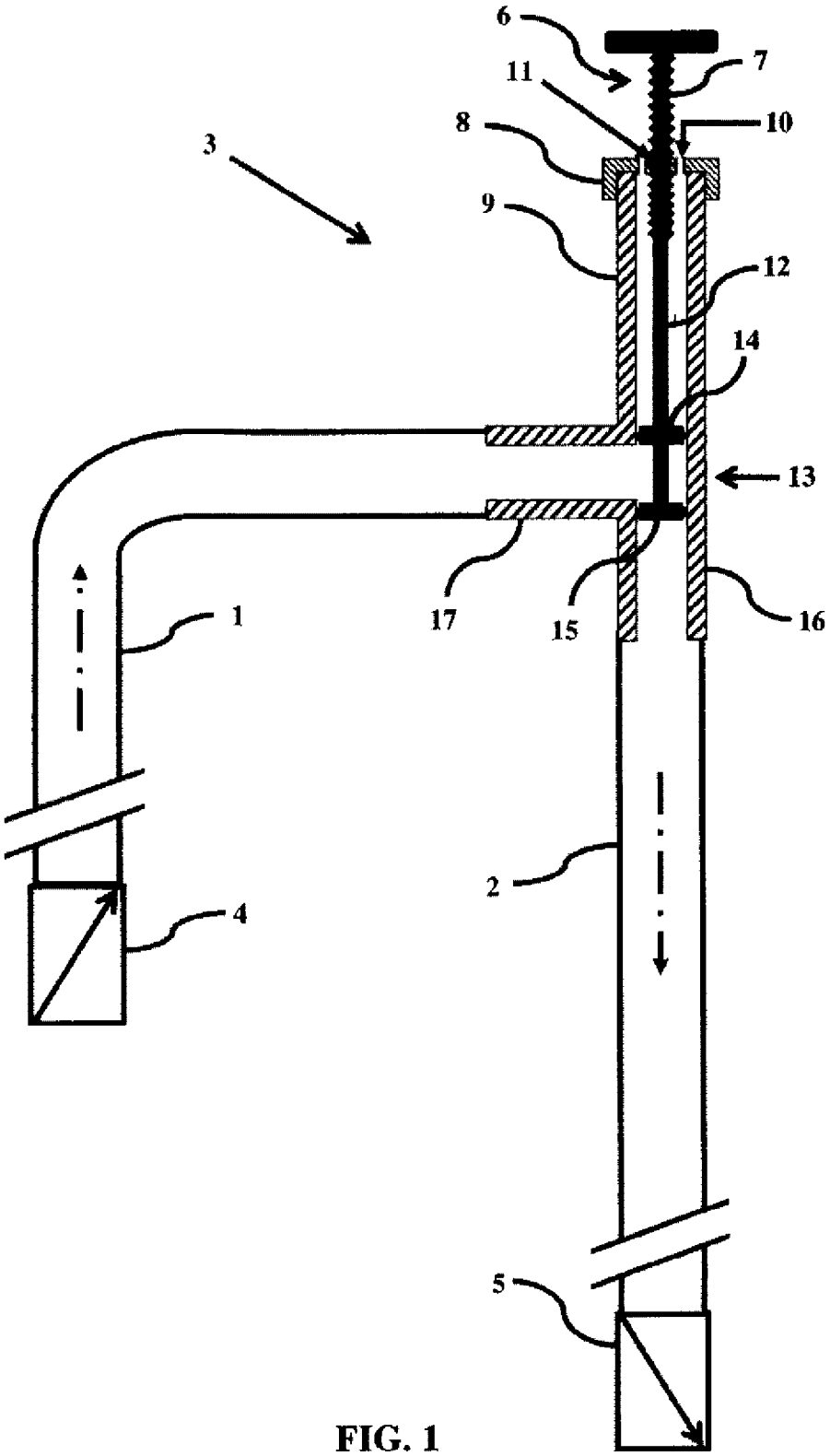
Figure 2:
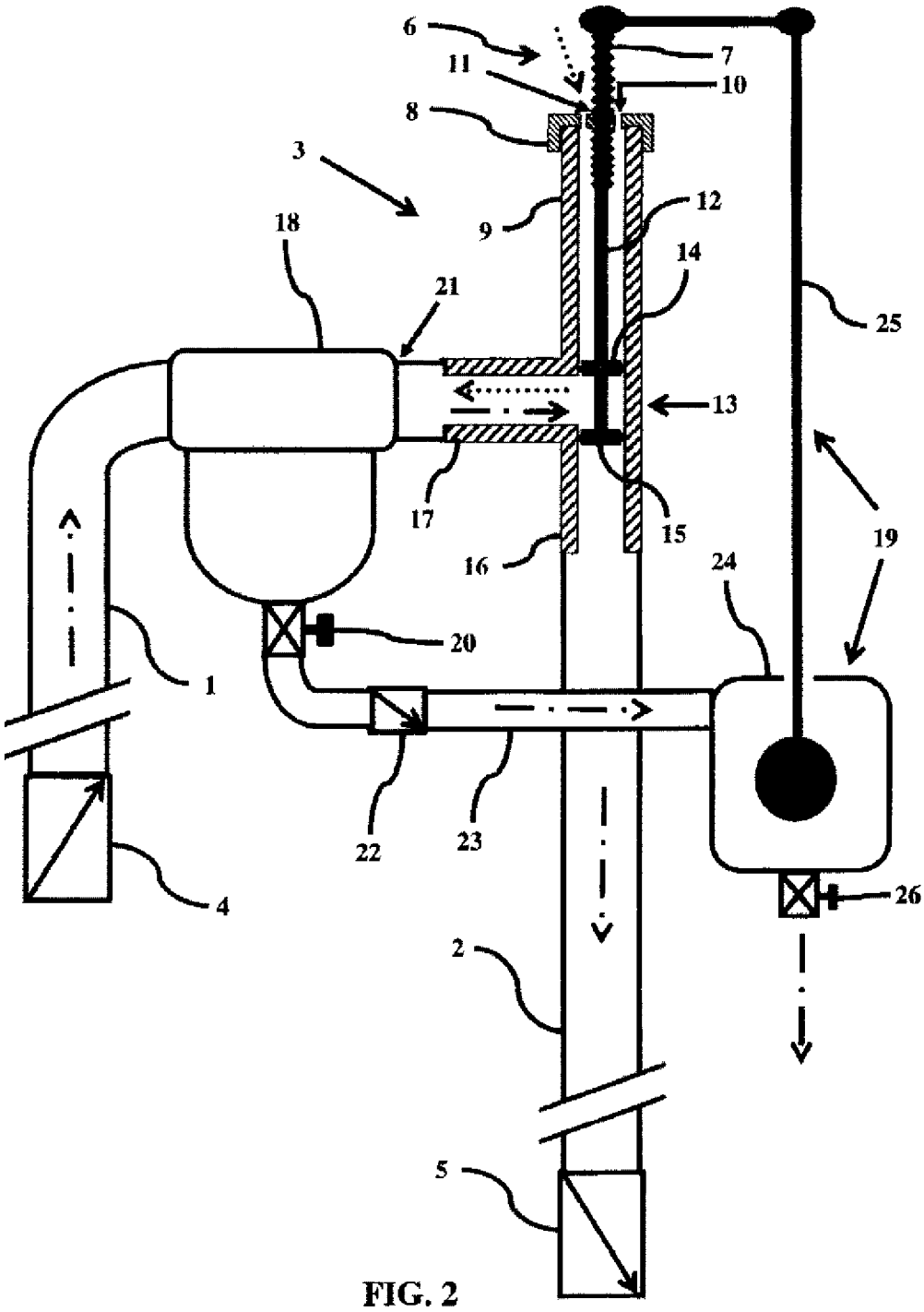
Figure 3:
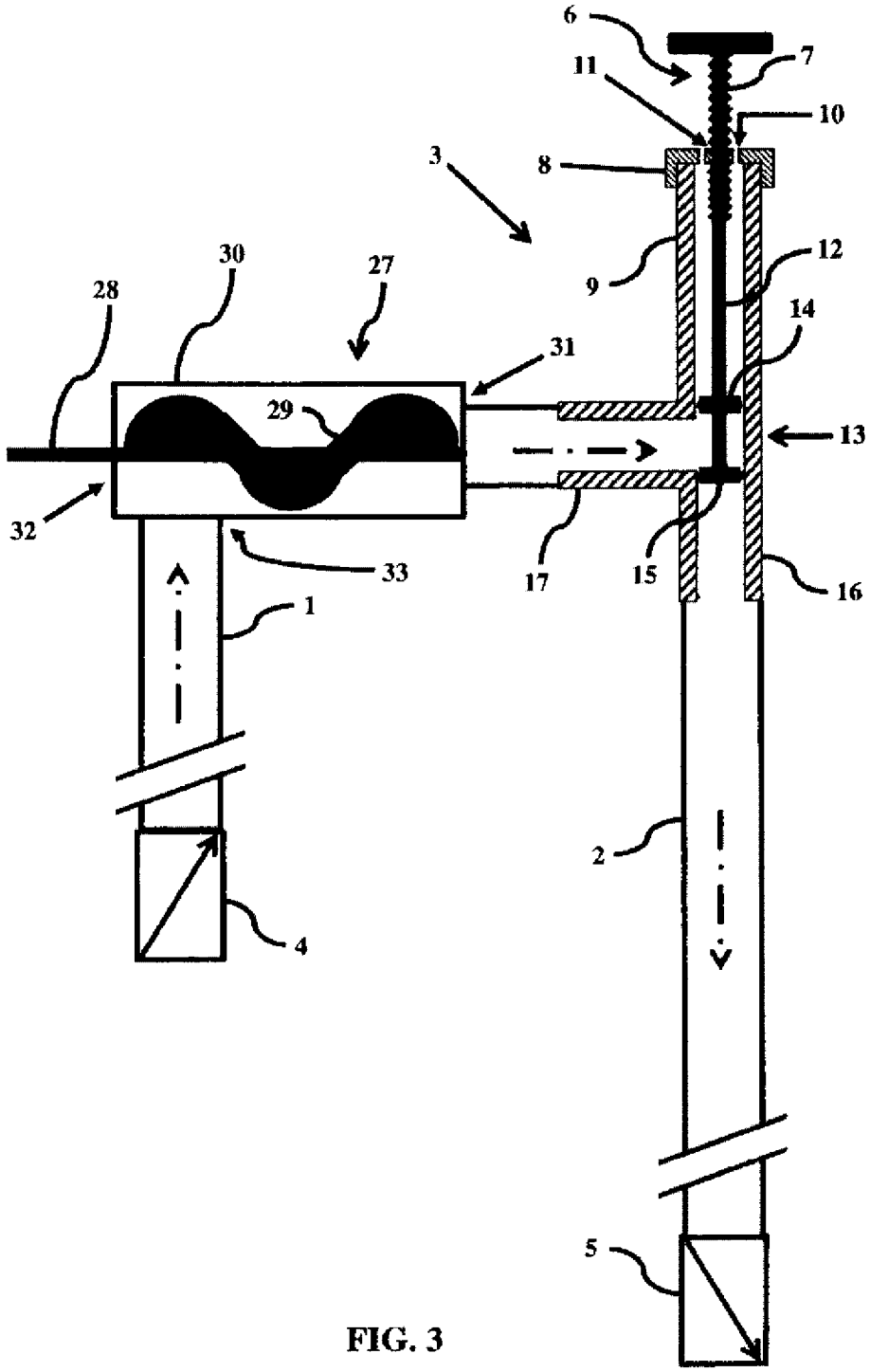
Figure 4:
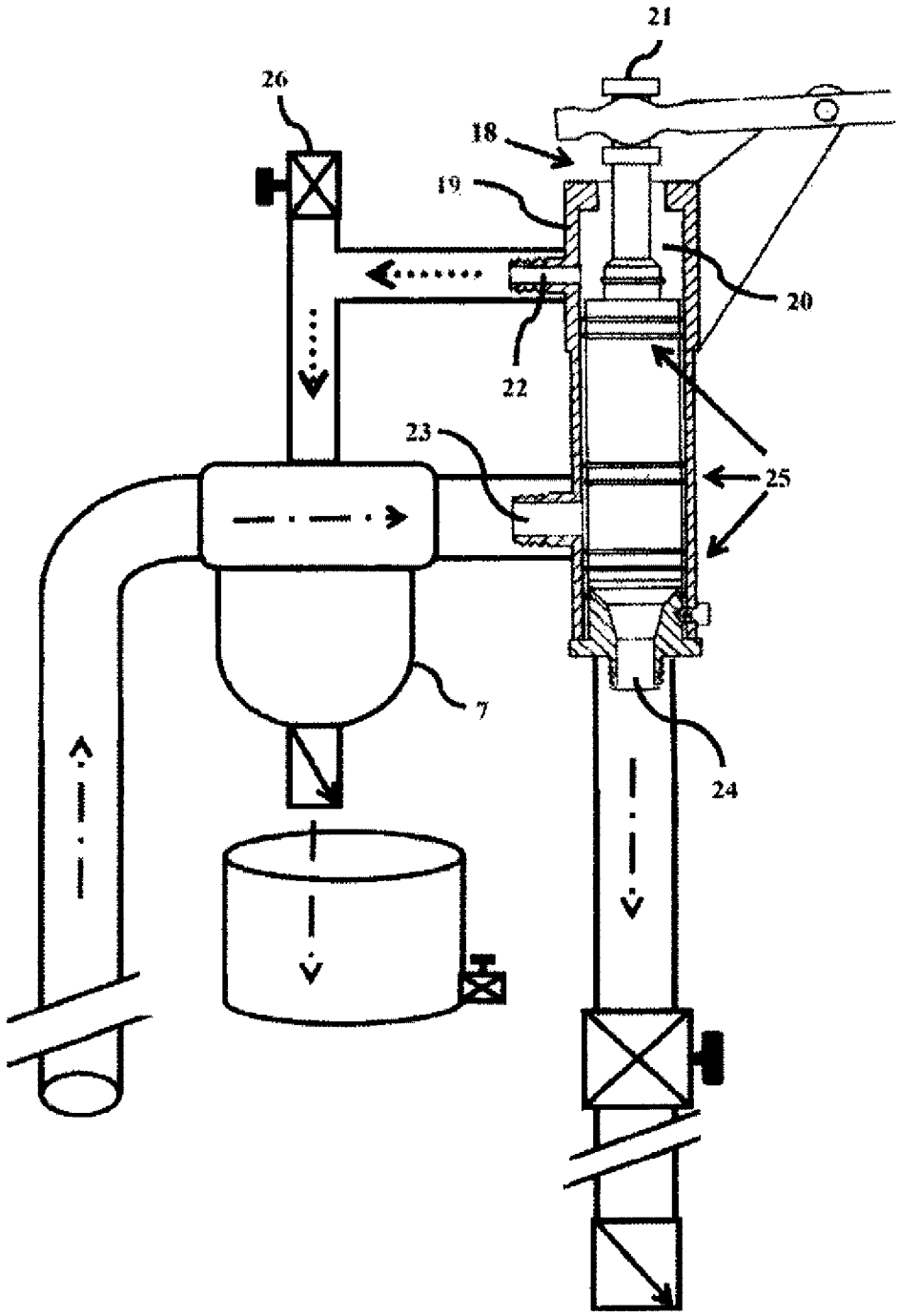
Figure 5:
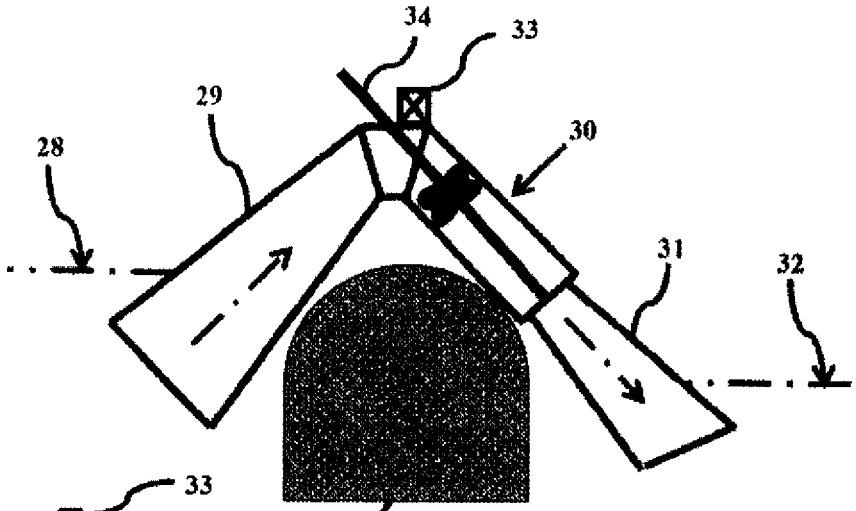
Figure 6:
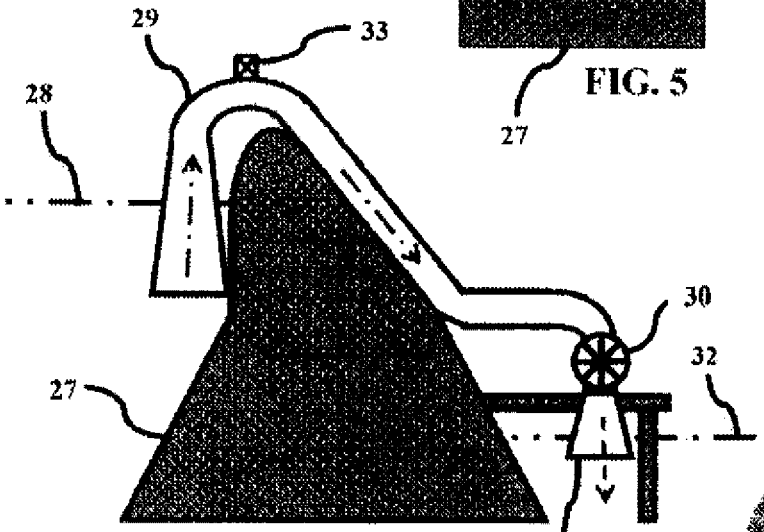
Figure 7:
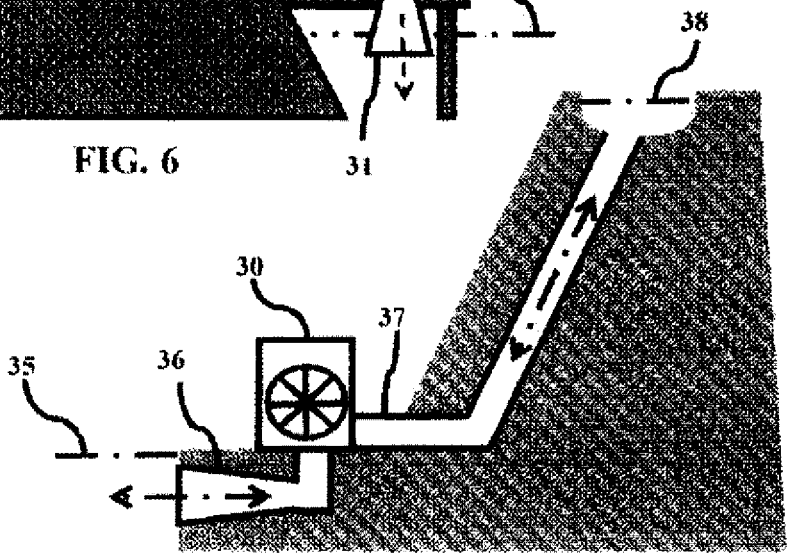
Figure 8:
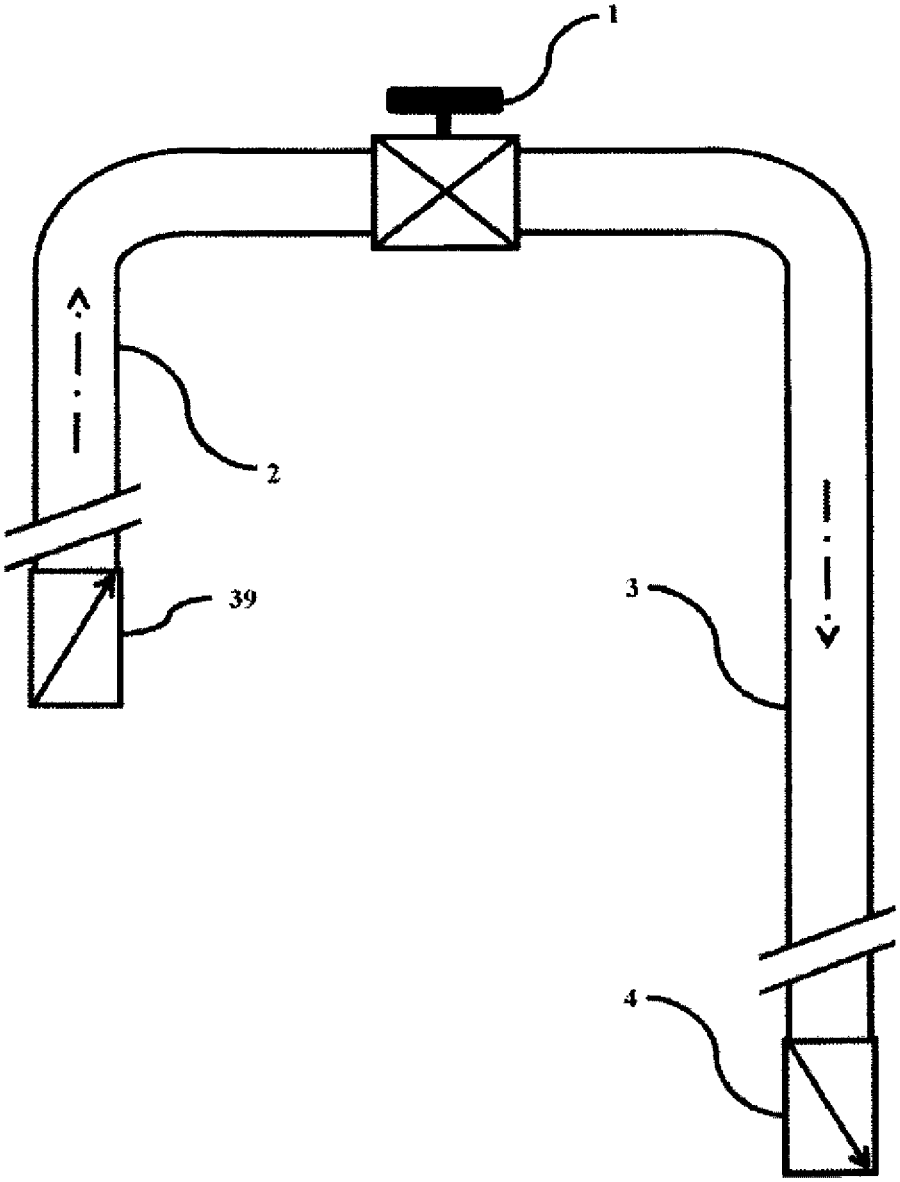
Figure 9:
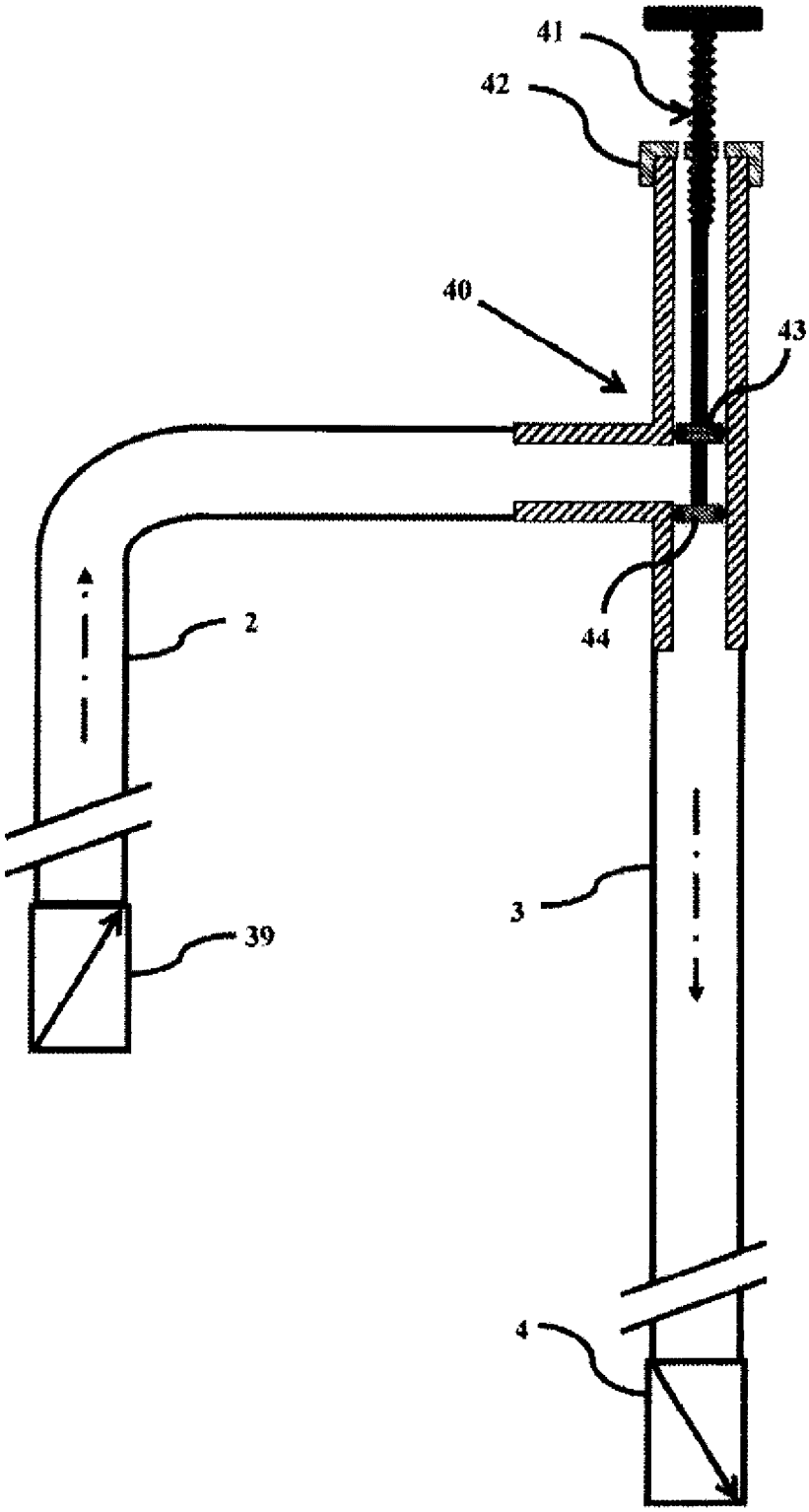
Figure 10:
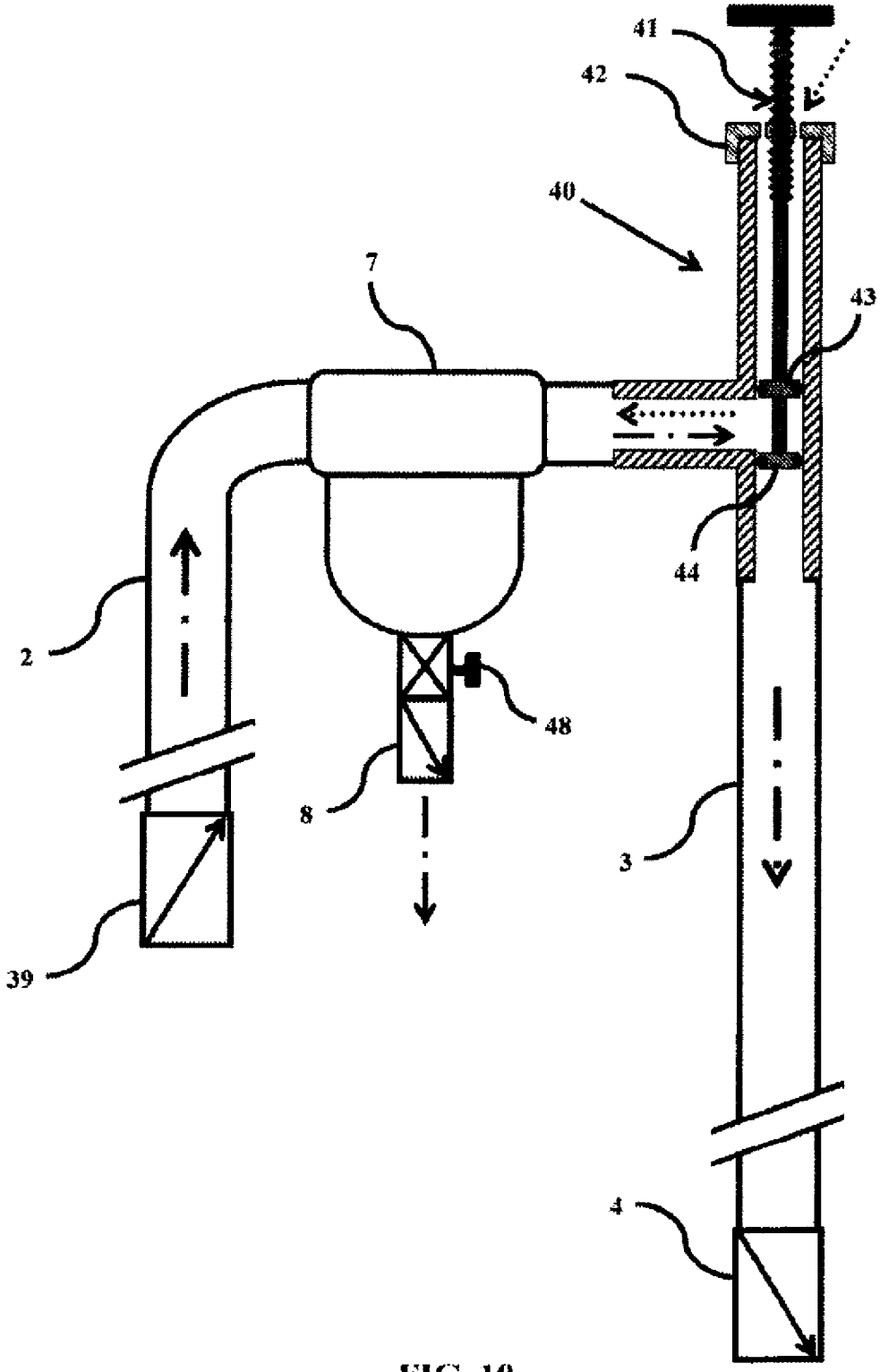
Figure 11:
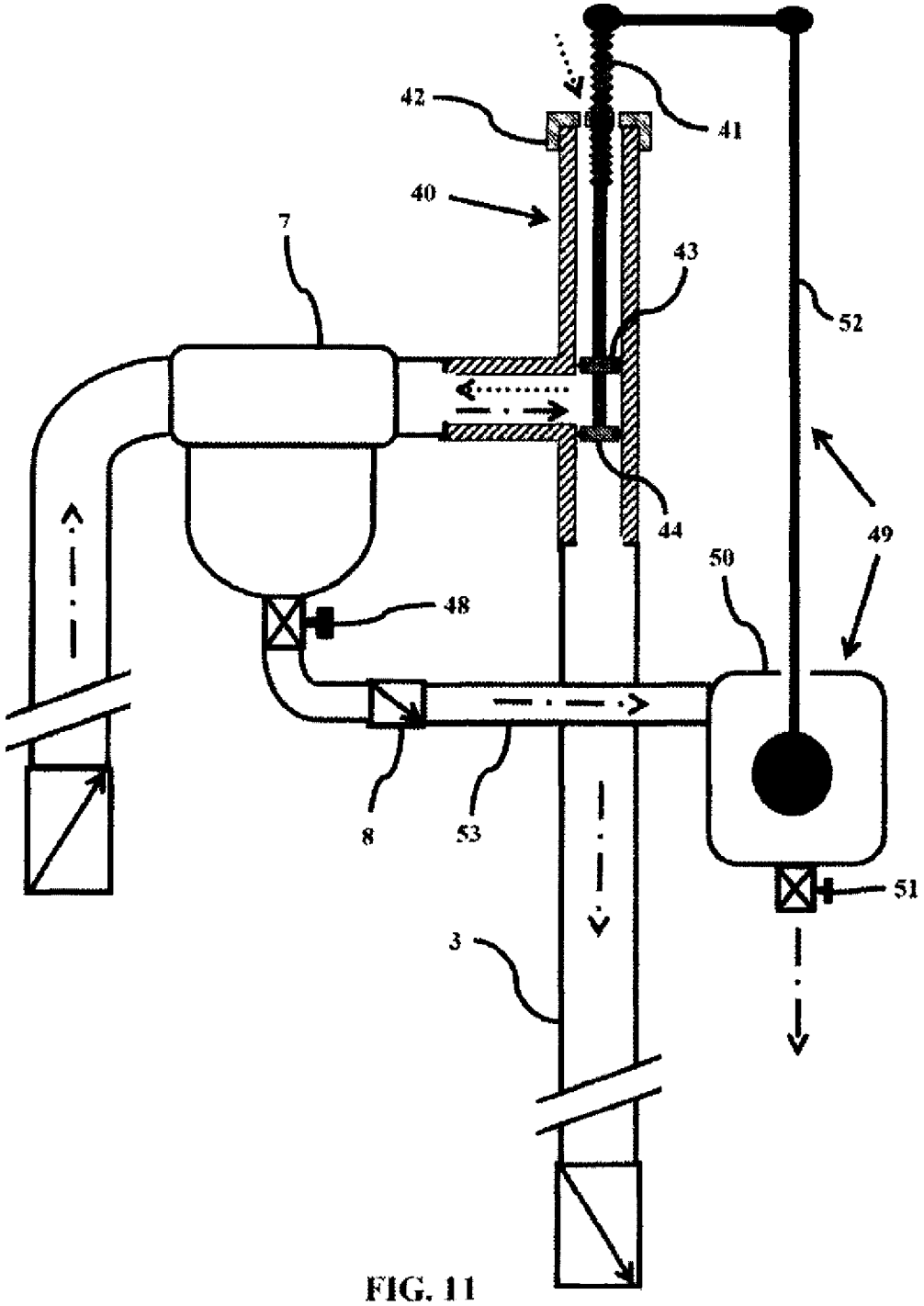
Figure 12:
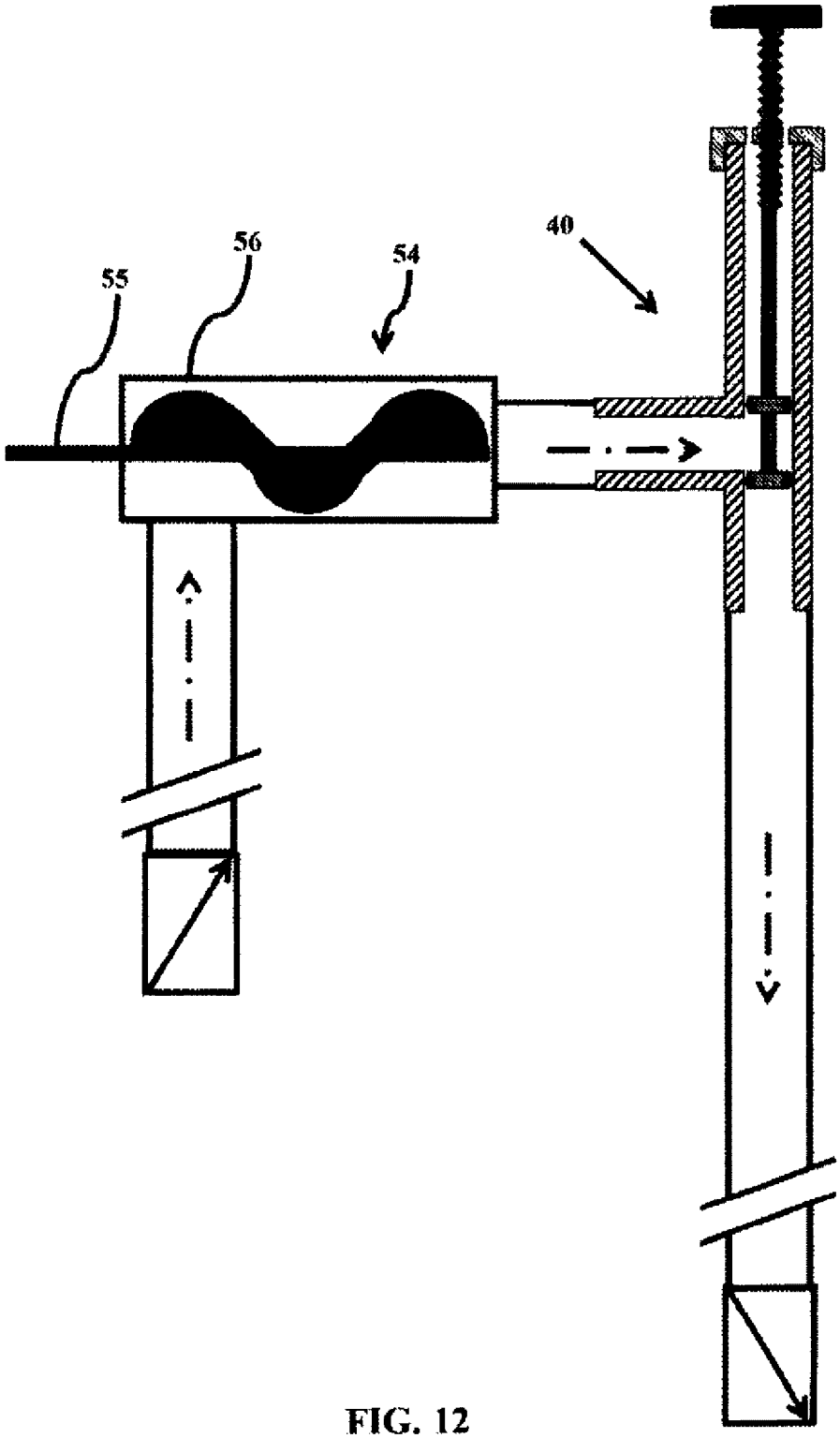

FIG. 12 illustrates a siphon pump system in combination with FIG. 9, and includes a turbine 54 having an arrangement of blades fixed on a shaft 55 to rotate within a cylindrical chamber 56 positioned above the supply source in the first siphon conduit 2 for connection to mechanical or electrical hydropower facilities. The amount hydropower generated is determined by the rotational speed of the turbine 54, which is controlled by the rate of siphon flow and regulated by the improved system flow control valve apparatus 40 for automatic siphoning, priming, start, stop, restart, and variable flow. Retention of full-system prime permits immediate restart after shut down for maintenance or other reasons. The improved system flow control valve apparatus 40 and turbine 54 can be located up to an elevation of 25 feet, safely above and at a distance from the supply source for operation, maintenance and protection from flooding. Scalable applications of the turbine siphon pump system for hydropower generation are not restricted to dam locations, but any supply source accessible by siphon technology with minimal impact.

What is claimed is:

1. A closable siphon pump system with single-point valve control featuring an improved system flow control valve apparatus to prime, pump, and regulate siphon flow, and terminal anti-backflow valves to maintain system prime to transfer liquids from a supply source via siphoning over an elevation in an uninterrupted stream to a point below said supply source above or within a destination; to forcibly pump liquids from said supply source to said point above or below said supply source and above or within said destination; and to forcibly prime said closable siphon pump system to establish system siphon flow without further priming after an initial prime, said closable siphon pump system comprising: a) a prior art siphon pump system comprising: (1) a first siphon conduit extending upward from an inlet of said first siphon conduit submerged within a liquid supply source to an outlet of said first siphon conduit communicating with an inlet of said improved system flow control valve apparatus disposed above said liquid supply source for upward movement of system siphon flow; (2) a second siphon conduit extending downward from an outlet of said improved system flow control valve apparatus disposed above said liquid supply source and communicating with an inlet of said second siphon conduit for downward movement of system siphon flow to an outlet of said second siphon conduit disposed below said liquid supply source and within or above said destination, and said second siphon conduit of greater length than said first siphon conduit sufficient to establish system siphon flow by force of gravity; (3) an anti-backflow valve communicating with said outlet of said second siphon conduit to establish one-way directional system siphon flow from said inlet of said first siphon conduit upward through said improved system flow control valve apparatus and downward through said second siphon conduit to exit said outlet of said second siphon conduit disposed below said liquid supply source within or above said destination; to prevent reverse flow into said second siphon conduit; and to provide an automatically closable second siphon conduit upon closure of said improved system flow control valve apparatus to retain prime for system readiness without further priming after said initial prime; b) wherein the improvement comprises: (4) an anti-backflow valve communicating with said inlet of said first siphon conduit to establish one-way directional system siphon flow from said inlet of said first siphon conduit upward through said improved system flow control valve apparatus and downward through said second siphon conduit to exit said outlet of said second siphon conduit disposed below said liquid supply source within or above said destination; to prevent return of liquid to said liquid supply source; and to provide an automatically closable first siphon conduit upon closure of said improved system flow control valve apparatus to retain prime for system readiness without further priming after said initial prime; and (5) the improved system flow control valve apparatus for single-point valve control communicating with said outlet of said first siphon conduit and said inlet of said second siphon conduit disposed above said liquid supply source to control start, stop, restart and vary system siphon flow through said first siphon conduit, said improved system flow control valve apparatus, and said second siphon conduit; to provide immediate control to transfer liquids from said liquid supply source via siphoning over said elevation in a selectively variable stream to exit below the supply source at said point above or within said destination; to control retention of system prime by means of said terminal anti-backflow valves responding automatically to closure of said improved system flow control valve apparatus without further priming after said initial prime; to forcibly prime said first siphon conduit, said improved system flow control valve apparatus, and said second siphon conduit to establish system siphon flow; and forcibly pump liquid above or below said liquid supply source to said point above or within said destination; said improved system flow control valve apparatus comprising: (a) a three-way valve body consisting of an upper valve body conduit and a side valve body conduit forming a valve controllable siphon flow path to enter said side valve body conduit from said outlet of said first siphon conduit and exit an outlet of a lower valve body conduit communicating with said inlet of said second siphon conduit; said upper valve body conduit and said lower valve body conduit forming an inline path for a valve stem assembly; and said upper valve body conduit externally threaded at an upper extremity to mate a removable cap, and disposed to accept said valve stem assembly; (b) said removable cap internally threaded to mate with said externally threaded upper extremity of said upper valve body conduit; an internally threaded central aperture to engage said valve stem assembly to control priming, pumping, and siphon flow; and said internally threaded central aperture encircled by perforations for air exchange during priming; and (c) said valve stem assembly comprising a shaft consisting of an upper threaded portion and a lower unthreaded portion, wherein said lower unthreaded portion is of a smaller diameter than said upper threaded portion; an upper air control valve seal and a lower siphon control valve seal affixed to said lower unthreaded portion; said upper threaded portion to engage a handle or other means of actuation at an upper extremity, and to engage an internally threaded central aperture of an internally threaded removable cap to control system siphon flow by rotating said valve stem assembly to position said upper air control valve seal within said upper valve body conduit to prevent entry of air into said siphon flow path, and position said lower siphon control valve seal in said siphon flow path to start, vary, stop, and restart siphon flow through said siphon flow path; and said upper threaded portion disengaged from said internally threaded removable cap by upward rotation until said lower unthreaded portion of said shaft passes freely through said internally threaded central aperture of said internally threaded removable cap to guide said valve stem assembly linearly to prime said closable siphon pump system by reciprocating said valve stem assembly to establish system siphon flow.

2. A closable metering siphon pump system with single-point valve control featuring an improved system flow control valve apparatus to prime, dispense, purge and regulate siphon flow; an improved metering chamber apparatus to periodically dispense metered quantities of liquid above a supply source; and terminal anti-backflow valves to maintain system prime to ensure periodic dispensing of liquid and recovery of system prime during purging of introduced air for subsequent dispensing without further priming after an initial prime, said closable metering siphon pump system comprising: a) wherein a prior art metering siphon pump comprises: (1) a first siphon conduit extending upward from an inlet of the first siphon conduit being submerged within a liquid supply source to an outlet of said first siphon conduit communicating with an upper inlet of said improved metering chamber apparatus disposed above said liquid supply source for upward movement of system siphon flow; (2) a second siphon conduit extending downward from an outlet of said improved system flow control valve apparatus disposed above said liquid supply source and communicating with an inlet of said second siphon conduit for downward movement of system siphon flow to an outlet of said second siphon conduit disposed below said liquid supply source and within or above a destination, and said second siphon conduit of greater length than said first siphon conduit sufficient to establish system siphon flow by force of gravity; (3) an anti-backflow valve communicating with said inlet of said first siphon conduit to establish one-way directional system siphon flow from said inlet of said first siphon conduit upward through said improved metering chamber apparatus and said improved system flow control valve apparatus, and downward through said second siphon conduit to exit said outlet of said second siphon conduit disposed below said liquid supply source and within or above said destination to prevent reverse flow into said second siphon conduit and to provide an automatically closable first siphon conduit upon closure of said improved system flow control valve apparatus to retain prime for system readiness without further priming after said initial prime; (4) an anti-backflow valve communicating with said outlet of said second siphon conduit to establish one-way directional system siphon flow from said inlet of said first siphon conduit upward through said improved metering chamber apparatus, said improved system flow control valve apparatus, and downward through said second siphon conduit to exit said outlet of said second siphon conduit disposed below said liquid supply source and within or above said destination to prevent return of liquid to said liquid supply source and to provide an automatically closable second siphon conduit upon closure of said improved system flow control valve apparatus to retain system prime for system readiness without further priming after said initial prime; b) wherein the improvement comprises: (5) the improved system flow control valve apparatus for single-point valve control communicating with an outlet of said improved metering chamber apparatus and said inlet of said second siphon conduit disposed above said liquid supply source to control start, stop, and restart the system siphon flow for periodic dispensing of metered quantities of liquid from said improved metering chamber apparatus, and subsequent purging of introduced air to recover system prime for further dispensing episodes; to forcibly prime said first siphon conduit, said improved metering chamber apparatus, said improved system flow control valve apparatus, and said second siphon conduit to maintain system prime upon closure of terminal anti-backflow valves responding automatically to closure of said improved system flow control valve apparatus, and without further priming after the initial prime, said improved system flow control valve apparatus comprising: (a) a three-way valve body consisting of an upper valve body conduit and a side valve body conduit forming a valve controllable siphon flow path to enter said side valve body conduit from said outlet of said first siphon conduit and exit an outlet of a lower valve body conduit communicating with said inlet of said second siphon conduit; said upper valve body conduit and said lower valve body conduit forming an inline path for a valve stem assembly; and said upper valve body conduit externally threaded at an upper extremity to mate with a removable cap, and disposed to accept said valve stem assembly; (b) said valve stem assembly comprising a shaft consisting of an upper threaded portion and a lower unthreaded portion, wherein said lower unthreaded portion is of a smaller diameter than said upper threaded portion; an upper air control valve seal and a lower siphon control valve seal affixed to said lower unthreaded portion; said upper threaded portion to engage a handle or other means of actuation at an upper extremity, and to engage an internally threaded central aperture of an internally threaded portion of said removable cap to control system siphon flow by rotating said valve stem assembly to position said upper air control valve seal within said upper valve body conduit to prevent entry of air into said siphon flow path, and position said lower siphon control valve seal in said siphon flow path to start, vary, stop, and restart siphon flow through said siphon flow path; and said upper threaded portion disengaged from said internally threaded portion of said removable cap by upward rotation until said lower unthreaded portion of said shaft passes freely through said internally threaded portion of said internally threaded removable cap to guide said valve stem assembly linearly to prime said closable siphon pump system by reciprocating said valve stem assembly to establish system siphon flow; and (c) said removable cap internally threaded to mate with said externally threaded upper extremity of said upper valve body conduit; said internally threaded portion comprising an internally threaded central aperture to engage said valve stem assembly to control priming and siphon flow; and said internally threaded central aperture encircled by perforations for air exchange during priming; (6) the improved metering chamber apparatus disposed above said liquid supply source to periodically dispense a quantity of liquid and permit recovery of system prime for subsequent periodic dispensing, and comprising an enclosed chamber having an upper inlet communicating with said first siphon conduit outlet for siphon flow to enter said improved metering chamber apparatus; an upper outlet communicating with said improved system flow control apparatus for air flow to enter said improved metering chamber apparatus via said perforations in said cap, said upper valve body conduit, and said side valve body conduit of said improved system flow control apparatus during a periodic dispensing episode, and for siphon flow to exit said improved metering chamber in an opposite direction through said upper outlet during a separate purging episode to recover system prime; and a lower outlet communicating with a flow control valve and an anti-backflow valve to periodically dispense a quantity of liquid above said liquid supply source; c) wherein the self-regulating metering siphon pump system further comprises: an improved self-regulating chamber apparatus for single-point valve control to actuate said improved system flow control valve apparatus to regulate periodic gravity-fed dispensing above said liquid supply source from said improved metering chamber apparatus, and purge introduced air to recover system prime for subsequent dispensing without further priming after the initial prime, said self-regulating chamber apparatus comprising: (1) a regulating chamber disposed above said liquid supply source and below said improved metering chamber apparatus to receive gravity dispensed flow from said improved metering chamber apparatus via said lower outlet communicating with said anti-backflow valve, said conduit, and said two-way flow control valve; an upper access aperture for a float assembly to respond to dispensed flow to control linkage for dispensing and purging episodes; and a lower aperture disposing a two-way flow control valve for regulating gravity flow from said regulating chamber to effect timing of periodic dispensing and purging episodes; (2) a float assembly disposed within said regulating chamber to respond to liquid level of dispensed flow to control linkage communicating with said float assembly and said valve stem disposing said air control valve seal and said system flow control valve seal to control system siphon flow, and timing of periodic dispensing and purging episodes; and (3) a linkage assembly communicating with said float assembly disposed within said regulating chamber and said valve stem assembly disposed within said improved system flow control valve apparatus for actuating said valve stem assembly to admit air for dispensing by opening said air control valve seal and closing said system flow control valve seal, and to permit system siphon flow to purge air and prime the system for the next dispense-purge cycle by closing said air control valve seal and opening said system flow control valve seal.

3. A closable turbine siphon pump system with single-point valve control featuring a siphon turbine apparatus to interface hydropower facilities for energy production, an improved system flow control valve apparatus to prime and regulate siphon flow and thereby siphon turbine speed, and terminal anti-backflow valves to maintain system prime without further priming after an initial prime, said turbine siphon pump system comprising: a) wherein a prior art siphon turbine comprises: (1) a first siphon conduit extending upward from an inlet submerged within an upstream water source to an outlet communicating with an inlet of the siphon turbine apparatus disposed above and distant from said upstream water source for upward movement of siphon flow for turbine rotation; (2) a second siphon conduit extending downward from an outlet of said siphon turbine apparatus to an outlet of the second siphon conduit disposed downstream for downward movement of system siphon flow for rotation of said siphon turbine apparatus within the turbine siphon pump system; b) wherein the improvement comprises: (3) an anti-backflow valve communicating with the inlet of said first siphon conduit to establish one-way directional system siphon flow from said inlet of said first siphon conduit submerged in said upstream water source upward through said siphon turbine apparatus, through said improved system flow control valve apparatus, and downward through said second siphon conduit to exit said outlet of said second siphon conduit disposed within or above a downstream destination to prevent return of liquid within said turbine siphon pump system to said upstream water source and to provide an automatically closable first siphon conduit upon closure of said improved system flow control valve apparatus to retain system prime for system readiness without further priming after an initial prime; (4) an anti-backflow valve communicating with the outlet of said second siphon conduit to establish one-way directional system siphon flow from said inlet of said first siphon conduit upward through said siphon turbine apparatus, through said improved system flow control valve apparatus, and downward through said second siphon conduit to exit said outlet of said second siphon conduit disposed within or above the downstream destination; to prevent reverse flow into said second siphon conduit; and to provide an automatically closable second siphon conduit upon closure of said improved system flow control valve apparatus to retain prime for system readiness without further priming after the initial prime; (5) the improved system flow control valve apparatus communicating with the outlet of said siphon turbine apparatus and the inlet of said second siphon conduit for single-point control of said siphon turbine apparatus to provide rotational energy for variable hydropower generation; said improved system flow control valve apparatus disposed above and distant from said upstream water source to control start, stop, restart and variable siphon flow to transfer water from said upstream water source over an elevation through said first siphon conduit, said siphon turbine apparatus, said improved system flow control valve apparatus, and said second siphon conduit and to exit downstream below said upstream water source at a point above or within the downstream destination; to maintain system prime upon closure of terminal anti-backflow valves responding automatically to closure of said improved system flow control valve apparatus, and without further priming after the initial prime; and to forcibly prime said first siphon conduit, said siphon turbine apparatus, said improved system flow control valve apparatus, and said second siphon conduit to establish system siphon flow, said improved system flow control valve apparatus comprising: (a) a three-way valve body consisting of an upper valve body conduit and a side valve body conduit forming a valve controllable siphon flow path to enter said side valve body conduit from said outlet of said first siphon conduit and exit an outlet of a lower valve body conduit communicating with said inlet of said second siphon conduit; said upper valve body conduit and said lower valve body conduit forming an inline path for a valve stem assembly; and said upper valve body conduit externally threaded at an upper extremity to mate with a removable cap, and disposed to accept said valve stem assembly; (b) said removable cap internally threaded to mate with said externally threaded upper extremity of said upper valve body conduit; an internally threaded central aperture to engage said valve stem assembly to control priming and siphon flow; and said internally threaded central aperture encircled by perforations for air exchange during priming; (c) said valve stem assembly comprising a shaft consisting of an upper threaded portion and a lower unthreaded portion, wherein said lower unthreaded portion is of a smaller diameter than said upper threaded portion; an upper air control valve seal and a lower siphon control valve seal affixed to said lower unthreaded portion; said upper threaded portion to engage a handle or other means of actuation at an upper extremity, and to engage the internally threaded central aperture of the internally threaded removable cap to control system siphon flow by rotating said valve stem assembly to position said upper air control valve seal within said upper valve body conduit to prevent entry of air into said siphon flow path, and position said lower siphon control valve seal in said siphon flow path to start, vary, stop, and restart siphon flow through said siphon flow path; and said upper threaded portion disengaged from said internally threaded removable cap by upward rotation until said lower unthreaded portion of said shaft passes freely through said internally threaded central aperture of said internally threaded removable cap to guide said valve stem assembly linearly to prime said closable siphon pump system by reciprocating said valve stem assembly to establish system siphon flow (6) the siphon turbine apparatus communicating with said outlet of said first siphon conduit and said improved system flow control apparatus and disposed in said path of siphon flow, above and distant from said water supply, and sealable to exclude penetration of air and retain prime during priming and operation of said closable turbine siphon pump system by means of said improved system flow control valve apparatus; the terminal anti-backflow valves responding automatically to operation of said improved system flow control valve apparatus to regulate flow and maintain system prime without further priming after the initial prime, said siphon turbine apparatus comprising: (a) a rigid cylindrical tube having an open distal aperture communicating with an inlet of said improved system flow control apparatus including an open framework having a smooth-bore central aperture to permit a shaft to rotate within; a closed proximal terminus having a smooth-bore central aperture to permit said shaft to rotate within, and sealed to prevent leakage; and a proximal aperture on a side of said rigid cylindrical tube communicating with said first siphon conduit outlet for incoming siphon flow; (b) said shaft disposed within said rigid cylindrical tube and secured in said proximal smooth-bore central aperture and said distal smooth-bore central aperture to rotate freely powered by a helical blade affixed to said shaft, and extending from said distal terminus through said proximal terminus and to a point beyond said proximal terminus for attachment to hydropower facilities; and (c) the helical blade approximating the diameter of said rigid cylindrical tube and affixed to said rigid cylindrical shaft within a distance between said proximal terminus and said distal terminus to rotate in response to system siphon flow regulated by said improved system flow control valve apparatus.

* * * * *

UNITED STATES PATENT AND TRADEMARK OFFICE

CERTIFICATE OF CORRECTION

PATENT NO. : 8,763,625 B1
APPLICATION NO. : 13/861789
DATED : July 1, 2014
INVENTOR(S) : Carter It is certified that error appears in the above-identified patent and that said Letters Patent is hereby corrected as shown below:

Please delete Patent 8763625 in its entirety and insert Patent 8763625 in its entirety as shown on the attached pages Signed and Sealed this
Twenty-ninth Day of December, 2015

Michelle K. Lee

Michelle K. Lee
*Director of the United States Patent and Trademark Office*

(12) United States Patent
Carter

(10) Patent No.: US 8,763,625 B1
(45) Date of Patent: Jul. 1, 2014

(54) SIPHON PUMP TECHNOLOGY AND APPARATUSES

(71) Applicant: John T. Carter, Harrodsburg, KY (US)

(72) Inventor: John T. Carter, Harrodsburg, KY (US)

( * ) Notice: Subject to any disclaimer, the term of this patent is extended or adjusted under 35 U.S.C. 154(b) by 0 days.

(21) Appl. No.: 13/861,789

(22) Filed: Apr. 12, 2013

(51) Int. Cl.
*F04F 10/00* (2006.01)
*G06F 12/08* (2006.01)

(52) U.S. Cl.
CPC ..... *G06F 12/08* (2013.01)
USPC ..... 137/149; 137/131; 137/137; 137/143

(58) Field of Classification Search
USPC ..... 137/130, 131, 132, 133, 142, 146, 147, 137/148, 149, 151, 434–451, 136, 137, 143, 137/150.5; 4/344, 373; 222/204
See application file for complete search history.

(56) References Cited

U.S. PATENT DOCUMENTS 108,087 A * 10/1870 Averell ..... 137/148
125,559 A * 4/1872 Fox ..... 137/142
161,775 A * 4/1875 Gearing ..... 114/185
2,854,017 A * 9/1958 Spielvogel et al. ..... 137/149
4,364,228 A * 12/1982 Eller ..... 60/398
4,545,528 A * 10/1985 Perez ..... 239/1
5,358,000 A * 10/1994 O'Hair ..... 137/124
6,926,026 B1 * 8/2005 Burgoyne ..... 137/149

* cited by examiner

*Primary Examiner* — John K Fristoe, Jr.
*Assistant Examiner* — Matthew W Jellett

(57) ABSTRACT

Apparatuses to enable single-point valve control of siphons, siphon pumps, metering siphon pumps, and turbine siphon pumps include terminal anti-backflow valves, a system flow control valve, a metering chamber, a self-regulating chamber, and a siphon turbine. The terminal anti-backflow valves provide automatically closable systems without further priming after an initial prime. The system flow control valve consolidates functions for priming, pumping, dispensing, and siphon flow regulation to provide single-point valve control. The metering chamber operated by a single-point system flow control valve enables periodic dispensing of liquid above a supply source. The self-regulating chamber controls a single-point system flow control valve to regulate a metering chamber for periodic dispensing. The siphon turbine provided with terminal anti-backflow valves and regulated by a single-point system flow control valve enables hydropower production. Benefits include precision control, single-point operation, safety, new applications, energy savings, installations without power facilities, and a renewable clean energy technology.

3 Claims, 10 Drawing Sheets

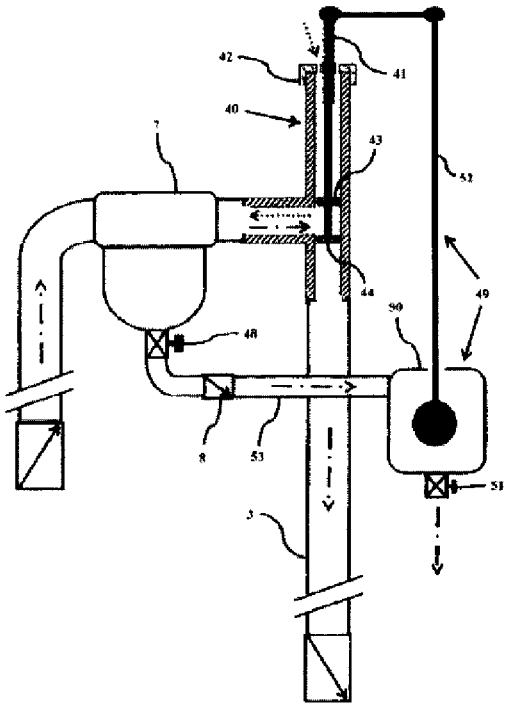

SIPHON PUMP TECHNOLOGY AND APPARATUSES

A non-provisional utility patent application for an Improved Siphon Pump Technology and Apparatuses related to single-point valve control for closable siphon pump systems is submitted Pro Se by John T. Carter, a USA citizen born Nov. 3, 1939, residing at 643 Keenon Road, Harrodsburg, Ky., 40330-8619; contact via email (johntcarter@usa.com) or cell phone (859-325-3271).

BACKGROUND OF THE INVENTION

1. Field of the Invention

The field of the invention encompasses Class 137 for flowable materials, Sub-Class 123 for siphons, and Class 415 for rotary pumps and Sub-Class 80 for runners. The invention relates to improvements in owned U.S. Pat. No. 5,358,000 and related prior art for a siphon pump technology that includes system components and apparatuses comprising an inlet anti-backflow valve, a system flow control valve, a metering chamber, an automatic regulating chamber, and a turbine. Improvements benefit the safe and controlled transfer of liquids such as water, chemicals, petroleum-based fuels, bio-fuels, beverages, and food products to achieve energy efficiency in operations and applications, and energy production via applications in hydropower generation.

2. Description of the Related Art

Descriptions of prior art related to an improved siphon pump technology are based on U.S. Pat. No. 5,358,000, a registered copyright, a prototype flow control valve, and hydropower technologies. Each description presents state of the art, identified problems or issues, and solutions.

a. Prior Art—Siphon System

Figure 1:
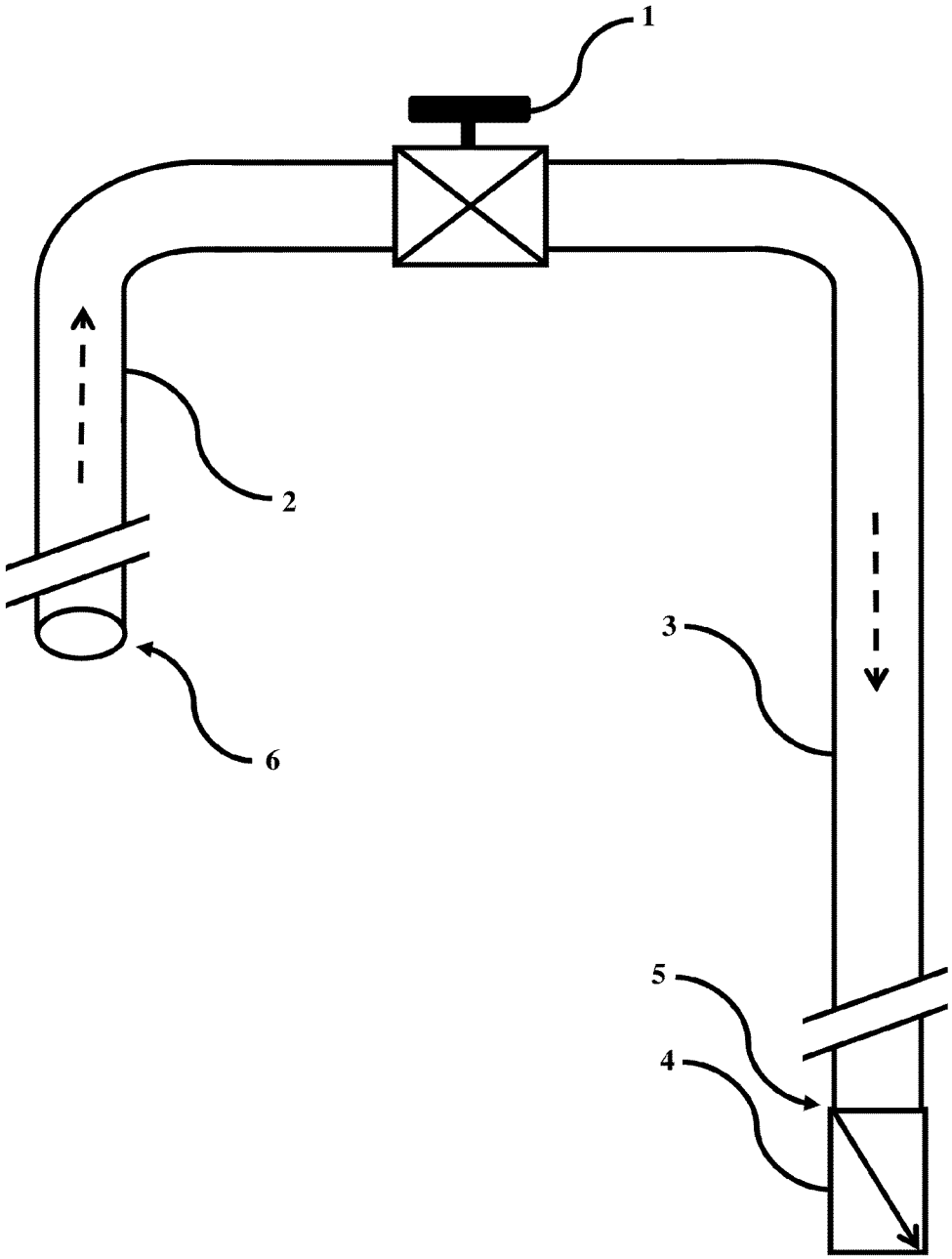
FIGS. 1-7 illustrate prior art.

FIG. 1 illustrates the elements and configuration for a siphon system described in copyright registration 1960282. The system comprises a two-way system flow control valve 1 arranged between the open inlet of the first siphon conduit 2 and the second siphon conduit 3 having an anti-backflow valve 4 within the outlet. Opening and closing of the anti-backflow valve 4 responds automatically to opening and closing, respectively, of the control valve 1. Priming the system requires filling the system with liquid at the first siphon conduit 2 open inlet while holding the anti-backflow valve 4 at the same level. Once filled, the system flow control valve 1 is closed to retain prime in the system for operation, transport, or storage. Placing the inlet of the first siphon conduit 2 in the liquid supply source and opening the control valve 1 to start siphon flow automatically opens the anti-backflow valve 4 to self-prime the system by purging entrained air. Once primed, operation of the system control valve 1 permits automatic siphoning and precision control of system start, stop, restart, and variable flow for rapid, repeated and safe operations without further priming, providing the first siphon conduit 2 remains within the supply source to retain full-system prime.

The problems associated with this configuration include required self-priming to initially purge air for a continuous, controlled flow, and loss of prime in the first siphon conduit 2 once removed from the supply source. The siphon system described for FIG. 8 and presented in claim 1 resolves these problems by the addition of an anti-backflow valve 39 within the inlet of the first siphon conduit 2 to prevent the return of liquid to the supply source and maintain full-system prime to eliminate the need for self-priming. The improved siphon system will expand scalable applications in the controlled transfer of liquids without further priming for rapid, repeated and safe operations.

b. Prior Art—U.S. Pat. No. 5,358,000 Metering Siphon Pump

Figure 2:
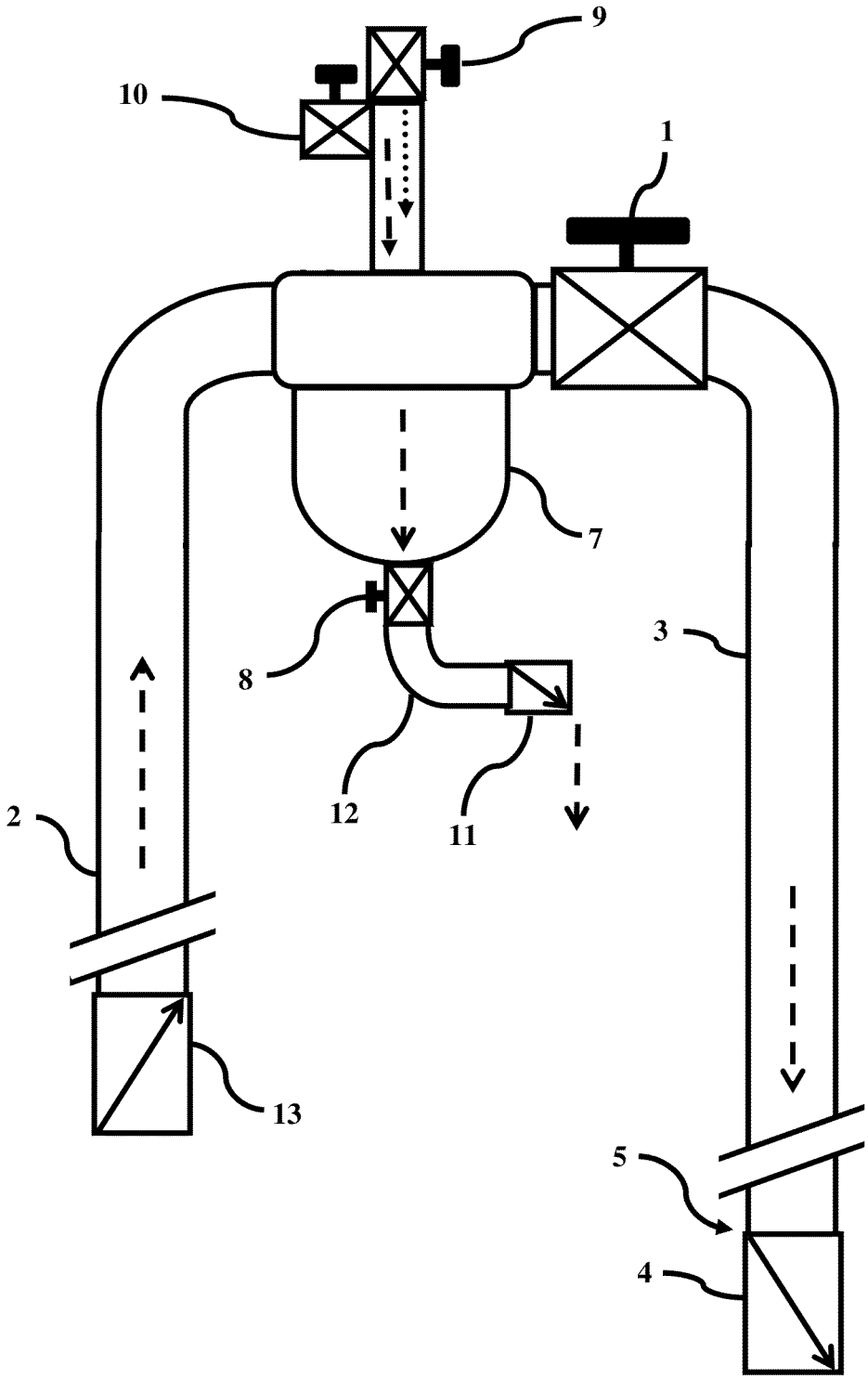

FIG. 2 illustrates the independent claim 1 configuration in U.S. Pat. No. 5,358,000 for a "Siphon Pump Having a Metering Chamber". The patent is a pioneering breakthrough to dispense liquids above the source, control flow, retain prime, and require less energy than powered pumps. The patent presents methodologies to successfully and economically pump liquid uphill for dispensing based on the siphon principle. Although the siphon principle has a theoretical limit of approximately 34 feet to pump liquid above the supply source, a more practical limit is 25 feet. However, arranging the systems in several tiers permits the next higher system to use the lower system as a supply source, extending the application of the siphon principle to pump liquid above the 25 foot limit; an advantage for applications in water management and hydropower.

The basic process involves first priming the system at the charging inlet 10, closing the system flow control valve 1 and then opening the air admitting valve 5 to dispense liquid into a destination container 6 from the metering chamber 7 via the anti-backflow valve 8 located above the supply source. Closing the air admitting valve 5 and opening the system flow control valve 1 permits siphon flow through the first 2 and second 3 siphon conduits and metering chamber 7 to purge newly introduced air and automatically prime the system for the next dispense-purge cycle. Proper operation requires an increase in the second siphon conduit 3 length to provide sufficient prime to restore the system for the next cycle. System stoppage is accomplished by closure of both the air admitting valve 5 and the system flow control valve 1; restart is automatic via opening of the system flow control valve 1.

Technical issues were identified that limit utility, make the system less effective, or even render the system inoperable. Independent claim 1 for U.S. Pat. No. 5,358,000 has deficiencies that include the omission of key elements, inclusion of unnecessary components, complexity of the metering chamber, and inadequate priming and control methodologies. Findings are listed by the original claim, associated technical issues and proposed solution:

(1). Claim 1: A siphon pump system for dispensing a predetermined quantity of water from a water supply source, . . . .

Issue: Supply source is limited to water; siphons pump any liquid.

Solution: Substitute liquid for water in Claims 1-5.

(2). Claim 1a: A destination container 6 for receiving water from the water supply source;

Issue: A destination container 6 is not a necessary element for siphon pump operation.

Solution: The destination container 6 may be eliminated in new claims.

(3). Claim 1b: A holding canister 7 including an air inlet valve 5 for allowing air to enter the system and an outlet check valve 8 for controlling the rate of flow of water from the holding canister 7 into the destination container 6, Issues: Separation of the air admitting valve 5 and the system flow control valve 1 limits control methodologies, and adds unnecessary complexity to the holding canister [metering chamber]; a critical control valve, omitted in the claims, controls the rate of flow, not the check (anti-backflow) valve 8 as specified.

Solution: Simplification of the holding canister [metering chamber] and system design with an improved multi-function system flow control valve apparatus, described for FIG. 9 and presented in claim 2, resolves the complexity and control issues.

(4). Claim 1e: A system flow control valve 1 positioned in the second siphon conduit 3 for controlling the flow of water through the first siphon conduit 2, the holding canister 7 [metering chamber], and the second siphon conduit 3; and Claim 1g: A flow control valve 9 in the second siphon conduit 3 upstream of the anti-backflow valve 4 for controlling flow of water through the first siphon conduit 2, the holding canister 7 [metering chamber], and the second siphon conduit 3;

Issue: Both valves perform the same function within the same conduit; a duplicate valve is unnecessary for siphon pump operation.

Solution: Eliminate duplicate flow control valve 1g 9 in the second siphon conduit 3.

(5). Claim 1h: A charging inlet 10 at an upper end of the holding canister 7 [metering chamber] for initially priming the siphon pump system;

Issue: Inclusion of the charging inlet 10 adds unnecessary complexity to the holding canister 7 [metering chamber].

Solution: Simplification of the holding canister [metering chamber], and an improved single-source system flow control valve apparatus, described for FIG. 9 and presented in claim 2, resolves the complexity and control issues.

(6). Claim 2: A siphon pump system in accordance with claim 1 including an anti-backflow valve positioned in the first siphon conduit 2 for preventing return of water within the system to the water supply source.

CRITICAL ISSUE: The anti-backflow valve was added as a dependent claim, not as an independent claim element. An anti-backflow valve is required in the stand-alone independent claim to prevent escape of liquid back to the supply source, and to retain liquid within the first siphon conduit 2 during all system operations. Absence of the anti-backflow valve renders the system inoperable as presented in U.S. Pat. No. 5,358,000 independent claim 1.

Solution: Include an anti-backflow valve as an element in the first siphon conduit inlet presented in Claims 1-5.

(7). Omitted Claim: a required control valve in the metering chamber 7 lower outlet was omitted in all U.S. Pat. No. 5,358,000 claims.

CRITICAL ISSUE: A control valve is required for closure of the holding canister [metering chamber] 7 during priming, and for regulation; liquid will escape from the metering chamber 7 during priming if not present, and regulation of the dispense-purge cycle depends upon adjustment of this valve. Absence of the control valve renders the system inoperable.

Solution: Include a lower outlet control valve as an element to the modified metering chamber in claims 2 and 3.

Issues associated with U.S. Pat. No. 5,358,000 and related prior art limit utility or render systems inoperable as originally claimed. The solutions described for FIG. 9 and presented in claim 2 attempt to expand utility for multiple applications, and improve system design and apparatuses for simplicity, control and functionality. Siphons are described as a gravity pumps, but are currently considered to have limited applications. Improvements will expand the potential for applications using the siphon principle as a power source to transfer liquids, dispense above the supply source, and contribute to the generation of hydropower.

c. Prior Art—U.S. Pat. No. 5,358,000 Automatic Timing Apparatus

Figure 3:
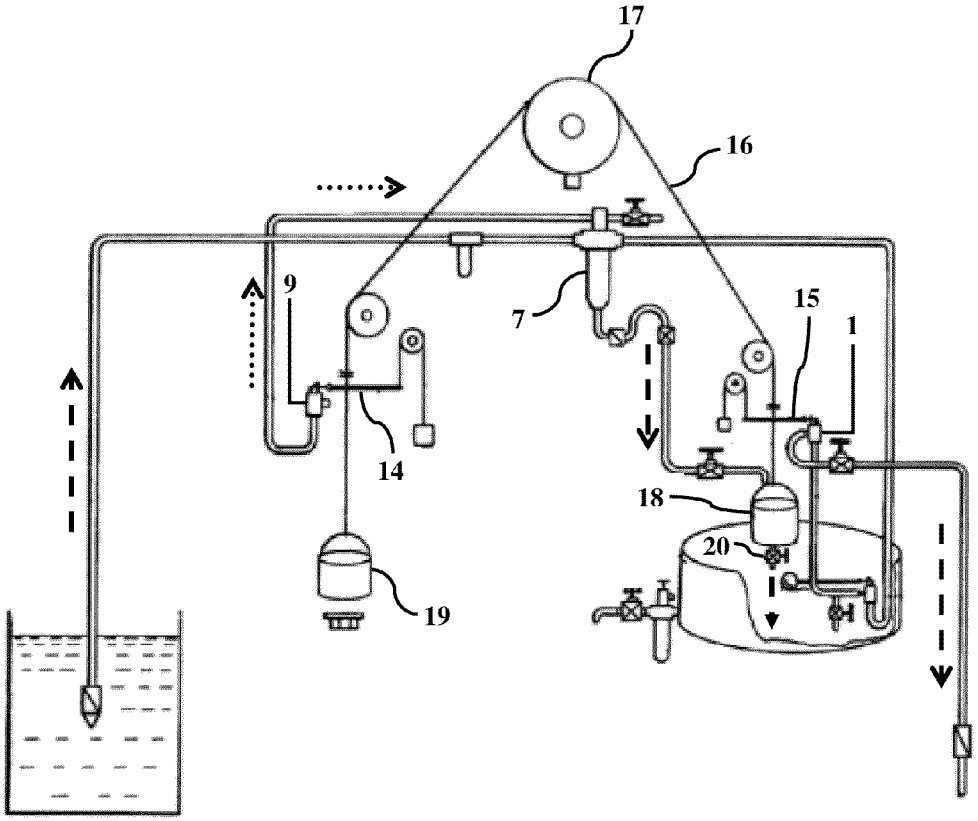

FIG. 3 illustrates U.S. Pat. No. 5,358,000 dependent claim 13 for an automatic timing apparatus to control dispensing of liquids above the source from the holding canister [metering chamber] 7, automatically and self-sustaining without the aid of any powered device using a complex configuration of mechanical elements and valves for control. The basic process involves actuation of the air admitting valve 5 and system flow control valve 1 via control arms 11 and 12, respectively, responding to the holding canister [metering chamber] 7 flow filling a timing bucket 13 connected by a cable 14 and pulley 15 arrangement to a counterweight 16, and timing of the opening and closure of the air admitting 5 and flow control 1 valves controlled by a control valve 17 in the timing bucket 13 adjusted to release water at a rate to ensure full system prime, and that the air admitting valve 5 and system flow control valve 1 are not open at the same time to prevent system collapse.

(1) Claim 13: A siphon pump in accordance with claim 1 including timing apparatus for automatically periodically controlling system siphon flow and for admitting air into the holding canister [metering chamber] for releasing water contained in the holding canister [metering chamber], the timing apparatus including air admitting valve actuation means including a pulley member and a cable passing over the pulley member and having a first end engageable with and supporting a timing bucket to receive water from the holding canister [metering chamber], and a second end supporting a counterweight having a predetermined weight, the cable including a first cable clamp member engageable with a control arm connected with and operative to control opening and closing of the system flow control valve, wherein the system flow control valve is closed when the timing bucket is empty of water and the system flow control valve is open when the timing bucket contains sufficient water to exceed the weight of the counterweight, the cable including a second cable clamp member engageable with a control arm connected with and operative to control opening and closing of the air admitting valve, wherein the air admitting valve is open when the timing bucket is empty of water and the air admitting valve is closed when the timing bucket contains sufficient water to exceed the weight of the counterweight, and wherein the timing bucket includes an outlet flow control valve to permit flow of water from the timing bucket into the destination container at a predetermined flow rate.

Issue: The timing apparatus requires a variety of antiquated mechanical and magnetic devices, is very complex, oversized, and restricted to separate two-way valves, and is not commercially feasible.

Solution: A complete re-design of the apparatus is necessary to reduce size, complexity, number and type of components for a practical, dependable, and commercially viable system. The description for FIG. 10 presented in claim 3 provides an improved automatic regulating chamber apparatus with linkage to the multi-function system flow control valve apparatus, ensuring that the control valve and the air admitting valve are not open at the same time during the dispensing and purging process, and ensuring the elapse of sufficient time between dispensing and purging to restore system flow.

d. Prior Art—Prototype System Control Valve

Figure 4:
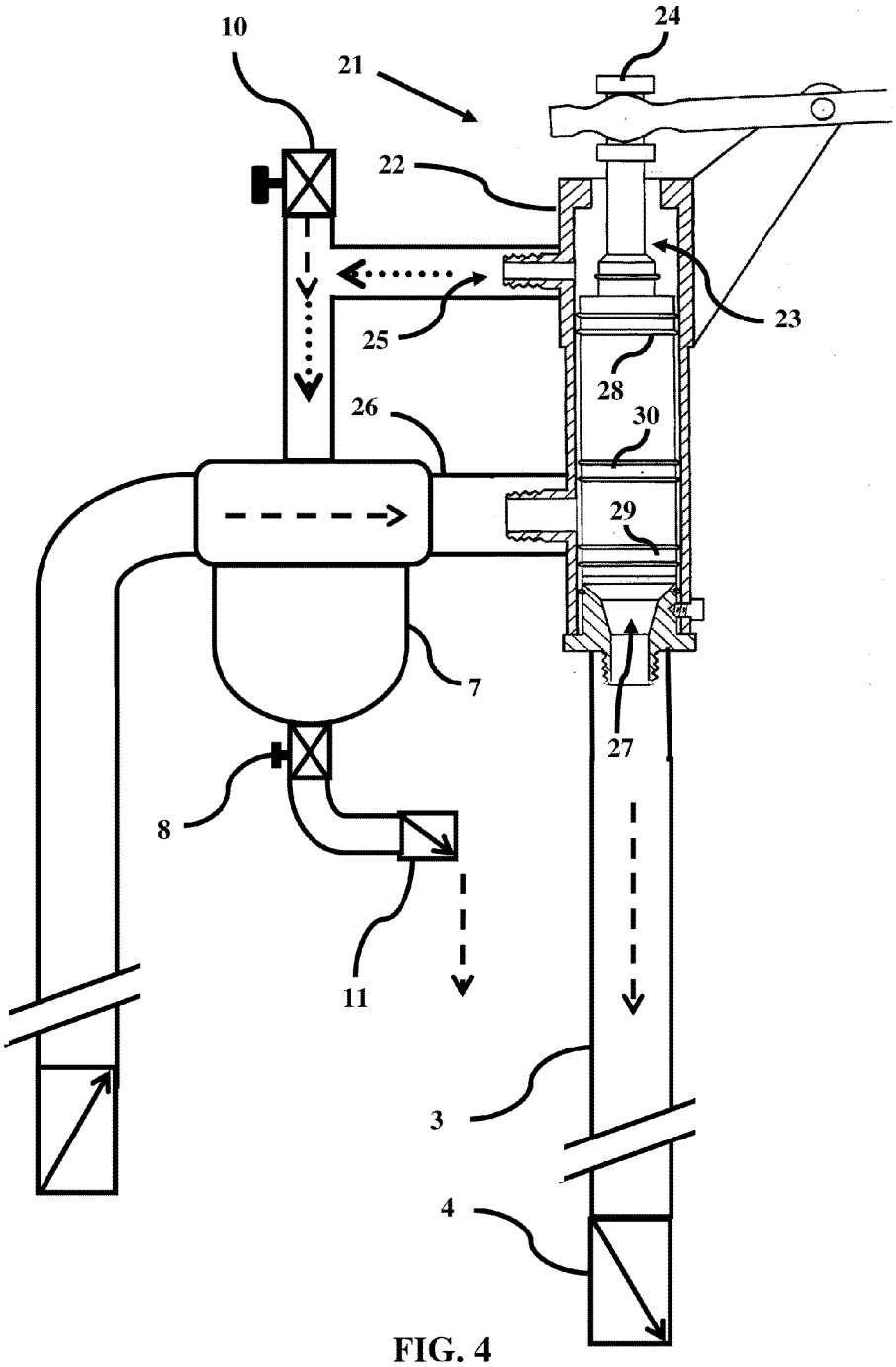

FIG. 4 illustrates a prototype system flow control valve 18 that combines the functions of system flow control and air admittance into a single manually operated four-way piston valve 18. The prototype valve 18 replaces the air admitting valve 5 of the holding canister [metering chamber] and the system flow control valve 1. The priming inlet 26 of the holding canister [metering chamber] 7 is not altered. The prototype comprises a four-way body 19 having a top inlet 20 for air admittance and valve stem 21 access and travel, a lower outlet 22 for admitting air into the metering chamber 7, a next-lower inlet 23 for siphon flow from the metering chamber 7, and a bottom outlet 24 for out-going siphon flow. The valve stem 21 comprises three sets of valve sections 25 to separate air flow and siphon flow by positioning the valves to permit air flow into the metering chamber 7 and simultaneously restrict siphon flow through the system, or to restrict air flow into the metering chamber 7 and simultaneously permit siphon flow through the system.

The problems associated with the prototype are massive weight and size, manual operation only, a limit of two functions, complex valve arrangements for air and liquid flow, and retention of holding chamber [metering chamber] complexity. The solution relies on the discovery that air and siphon flow could use the same conduit, but in opposite directions, because each process is conducted separately, and alternately. Therefore, the air admitting valve section 25 and conduit 22 may be eliminated by combining the air admittance and siphon flow functions via the siphon inlet conduit 23. The improved system flow control valve apparatus resolves the issues for air control, siphon flow control, dispensing, and priming as described for FIGS. 10 and 11 and presented in claims 3 and 4 with a reduction in size, weight, and complexity. The improvement maintains air flow separate from siphon flow during the dispense-purge cycle, a critical requirement to prevent system collapse, and consolidates all system functions for single-source operation.

e. Prior Art—Hydropower Technologies

Figure 5:
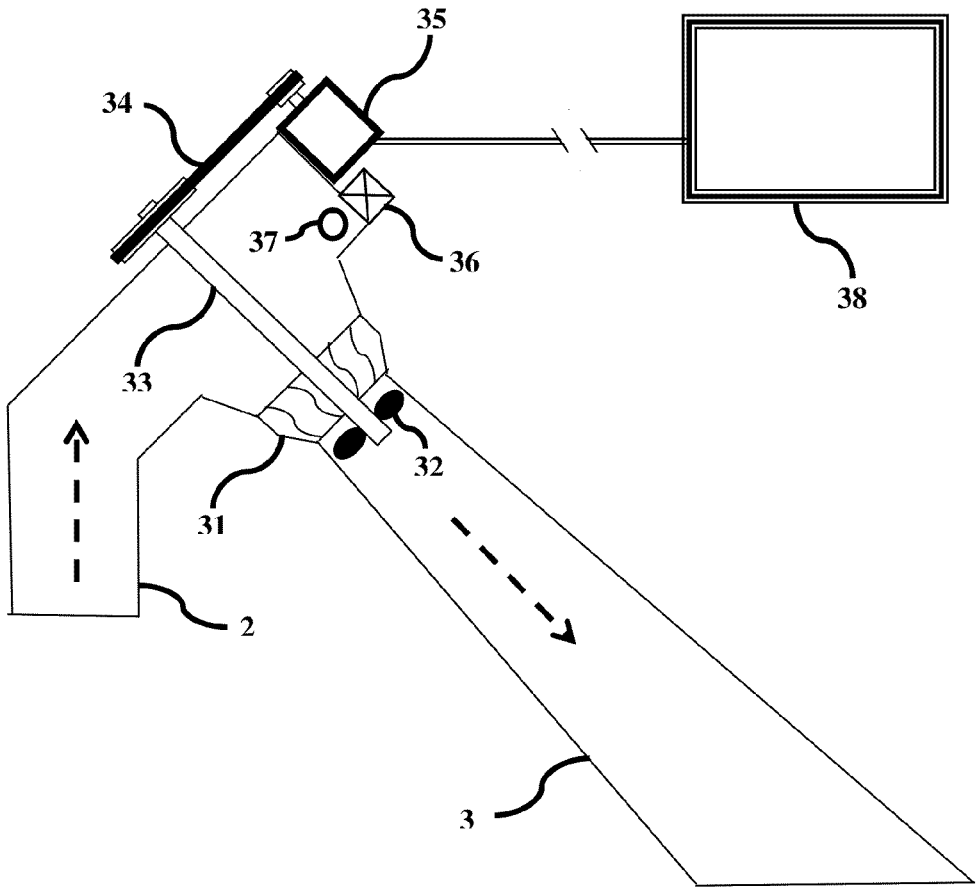
Figure 6:
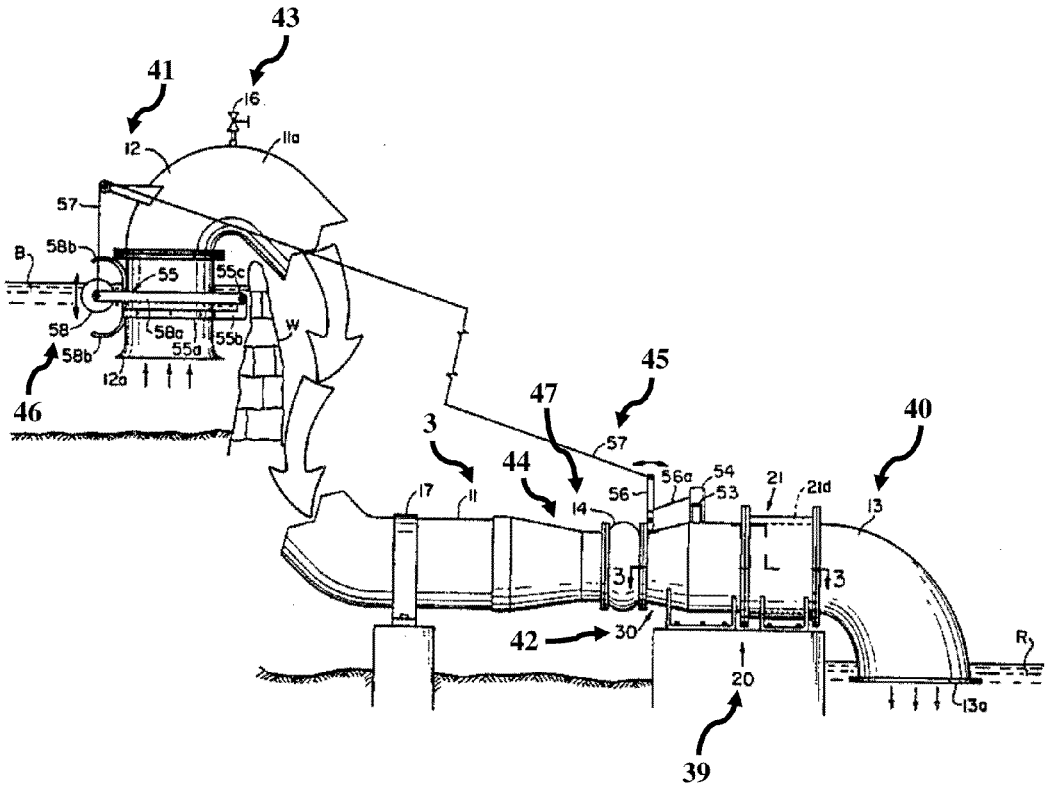
Figure 7:
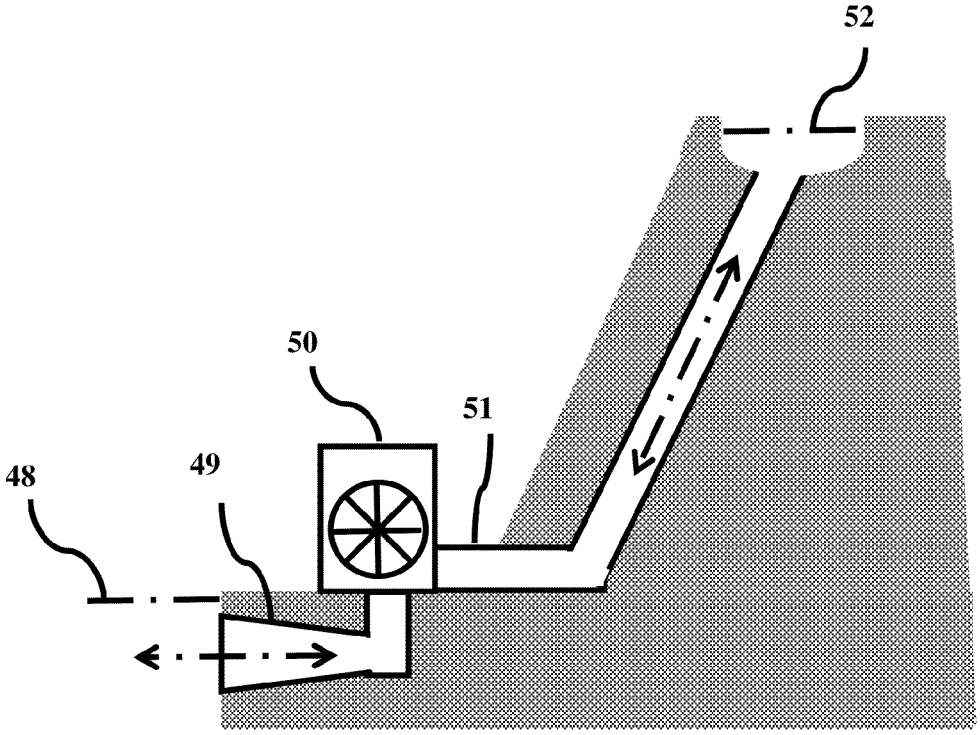

FIGS. 5, 6 and 7 illustrate current hydropower technologies for generating power from streams, reservoirs, and pumped storage ponds. Proposed improvements and apparatuses in siphon pump technology described herein contribute to energy production via turbine siphon pump systems, siphon pump intakes, and metering siphon pumps for pumped storage.

FIG. 5 illustrates a siphon turbine represented by the "Variable Speed Siphon Propeller Turbine" in operation by Derwent Hydro in Derbyshire, United Kingdom. The siphon turbine is located at a small dam 27 on a stream, and shown less the mechanical and electrical gear. Priming is achieved using a suction pump to pull upstream flow 28 into the intake 29 until it flows through the turbine 30 and outlet 31 sufficient to establish a continuous siphon flow downstream 32. The operating speed of the turbine is changed by a variable-speed control system. The system is shut down by opening a valve 33 in the siphon conduit to break the siphon. The turbine consists of a bladed shaft 34 enclosed within the turbine housing 30 for connection to hydropower generating gear.

The problems associated with the siphon turbine design include limited scalability and flow control methodology, required priming after system shut down, and proximity to the water source risking functionality and/or flood damage. A solution is described for FIG. 12 and presented in claim 5 to incorporate a turbine into a siphon pump system having an improved system flow control valve apparatus, an anti-backflow valve in the first siphon conduit inlet, and an anti-backflow valve in the second siphon conduit outlet. The system flow control apparatus features single-source system control for priming and instant response for start, stop, restart, and variable flow necessary for controlled hydropower generation. System design with anti-backflow valves at inlet and outlet terminuses maintains full-system prime even at shut down. Placement of both the control valve and turbine at the crown permits access for operation, maintenance and protection from flooding up to 25 feet above the supply source, and at a safe distance from the supply source. Since power generation is determined by flow control, the turbine siphon pump system will replace the priming pump, variable-speed control system, and siphon-breaking valve. Importantly, the improved system may be scaled from portable low-power low-head applications on streams to fixed high-power high-head facilities at reservoirs.

FIG. 6 illustrates a typical siphon intake or penstock at a hydropower generating facility represented by U.S. Pat. No. 4,629,904 for a micro-hydroelectric power plant. The turbine is located below the supply source 28 at a reservoir dam 27 with a siphon penstock inlet 29 upstream 28 and system outlet 31 downstream 32. Opening a siphon-breaking valve 33 at the siphon crown will shut the system down, while speed control and priming require separate powered equipment.

The problems associated with the siphon penstock design include lack of prime retention, limited flow control, and required priming at system shut down. The solution is described for FIG. 9 and presented in claim 2 for a siphon pump system having an improved system flow control valve apparatus. The anti-backflow valve at the second siphon outlet may be directly connected to the turbine input, with single-source control for priming and instant response for start, stop, restart, and variable flow. System design with anti-backflow valves at inlet and outlet terminuses maintains full-system prime even at shut down for instant restart response. The improved system flow control valve apparatus may be located up to 25 feet above the supply source, and at a safe distance from the supply source for ease of operation, maintenance, and protection from flooding. Since power generation is determined by flow control, the improved turbine siphon pump system will replace the priming pump, turbine speed control system, and siphon-breaking valve.

FIG. 7 illustrates a typical hydropower generating facility having a pumped storage system represented by the TVA Raccoon Mountain Pumped Storage Plant located on the Tennessee River near Chattanooga, Tenn. During low demand periods, water is pumped from a stream or reservoir 35, into a bi-directional conduit 36, through the bi-directional turbine 30, and upward through a bi-directional conduit 37 to a hilltop reservoir 38 to create a supply source. During periods of high demand, water is released in the opposite direction to drive the turbine 30 at a lower elevation to generate hydropower.

The problem with pumped storage systems is the electrical energy required to pump the water to a higher elevation, and limited to periods when demand is low. Solutions to elevate water into a reservoir are described for FIGS. 10 and 11, and presented in claims 3 and 4 for metering siphon pump systems. By arranging metering siphon pumps in a tiered fashion using the next-lowest system as a supply source, water may be pumped to elevations exceeding the normal 25 foot limitation for siphon technology separate from any generating equipment, and without any restrictions due to demand periods.

SUMMARY OF THE INVENTION

An Improved Siphon Pump Technology and Apparatuses invention encompasses Class 137, Sub-Class 123, Class 415, and Sub-Class 80. Improvements for the safe and controlled transfer of liquids includes system components and apparatuses comprising an inlet anti-backflow valve, a system flow control valve, a metering chamber, an automatic regulating chamber, and a turbine. The closed siphon pump technology has in common the unique combination of a control valve separating anti-backflow valves at the system inlet and outlet for precision flow control, prime retention, and automatic siphoning. Prior art includes a siphon system, U.S. Pat. No. 5,358,000 having a metering chamber and an automatic timing apparatus, a prototype system flow control valve, and hydropower technologies. The prior art has problems related to self-priming, retention of prime, flow control, and design complexity. Technical issues identified in U.S. Pat. No. 5,358,000 render the metering siphon pump system inoperable. Deficiencies in the patent include the omission of key elements, inclusion of unnecessary components, complexity of the metering chamber, and inadequate priming and control methodologies. The automatic timing apparatus to control metering involves a complex arrangement of multiple valves, mechanical systems, and magnetic devices that rely on critical timing for operation, limiting the feasibility for commercial applications. The prototype system flow control valve has problems associated with massive weight and size, limited control functions, complexity of design and operation, and manual operation only. Hydropower technologies have limited scalability, risk of functionality and/or flood damage due to proximity of supply source, lack of prime retention, limited flow control, and required priming at system shut down.

Improvements focus on system design and control apparatuses. Claim 1 (FIG. 8) specifies a siphon system having an inlet anti-backflow valve to retain full-system prime. Claim 2 (FIG. 9) specifies a siphon pump system having an inlet anti-backflow valve to retain full-system prime, and a system flow control valve apparatus for pumping, priming and control of start, stop, restart, and variable flow. Claim 3 (FIG. 10) specifies a siphon pump system in accordance with claim 2 having a metering chamber apparatus for dispensing. Claim 4 (FIG. 11) specifies a siphon pump system in accordance with claim 3 having an automatic regulating chamber apparatus for actuation of the system flow control valve apparatus to control periodic self-sustained dispensing from the metering chamber. Claim 5 (FIG. 12) specifies a siphon pump system in accordance with claim 2 having a turbine for connection to mechanical and electrical hydropower generating facilities. Applications of the improved siphon pump technology will benefit food production, water management, and energy development.

BRIEF DESCRIPTION OF THE DRAWINGS

FIGS. 1-7 illustrate prior art; FIGS. 8-12 illustrate claim embodiments. Broken directional arrows indicate liquid flow; dotted directional arrows indicate air flow.

FIG. 1: Prior Art Siphon System Having a Control Valve and Outlet Anti-Backflow Valve.

FIG. 2: Prior Art U.S. Pat. No. 5,358,000 Independent Claim 1 for a Siphon Pump Having a Metering Chamber.

FIG. 3: Prior Art U.S. Pat. No. 5,358,000 Dependent Claim 13 for an Automatic Timing Apparatus for a Siphon Pump Having a Metering Chamber.

FIG. 4: Prior Art Prototype System Flow Control Valve for a Siphon Pump Having a Metering Chamber.

FIG. 5: A Commercial Siphon Turbine System Mounted Above the Supply Source for Generating Hydropower.

FIG. 6: A Typical Siphon Intake for a Turbine System Mounted Below the Supply Source for Generating Hydropower.

FIG. 7: A Typical Pumped Storage System Providing a Supply Source for Generating Hydropower.

FIG. 8: An Improved Siphon System Having an Inlet Anti-backflow Valve for Full-Time Prime Retention.

FIG. 9: A Siphon Pump System Having an Improved System Flow Control Valve Apparatus for Priming and Precision Flow Control.

FIG. 10: A Siphon Pump System Having an Improved Metering Chamber and an Improved System Flow Control Valve Apparatus for Dispensing a Measured Quantity of Liquid above the Supply Source.

FIG. 11: A Siphon Pump System Having an Improved Regulating Chamber Apparatus for a Siphon Pump Having a Metering Chamber.

FIG. 12: A Siphon Pump System Having a Turbine and Improved System Flow Control Valve Apparatus for Generating Hydropower.

DETAILED DESCRIPTION OF THE INVENTION

FIGS. 8 through 12 illustrate the following detailed descriptions for an Improved Siphon Pump Technology and Apparatuses presented in Claims 1 through 5, respectively.

FIG. 8 illustrates an improved siphon system having an anti-backflow valve 39 at the first siphon conduit 2 inlet for full-time prime retention to maintain system readiness. The system comprises a two-way system flow control valve 1 arranged between the first siphon conduit 2 having an anti-backflow valve 39 within the inlet, and a second siphon conduit 3 having an anti-backflow valve 4 within the outlet. Opening and closing of the inlet 39 and outlet 4 anti-backflow valves automatically responds to the opening and closing of the two-way system flow control valve 1. Priming is accomplished by placing the inlet of the first siphon conduit 2 in a liquid supply source and operating a suction device to withdraw air via the second siphon conduit 3 outlet until the system is filled with liquid, or vertically moving the siphon conduit inlet 2 up and down until the system is filled with liquid. Once filled, closure of the system flow control valve 1 retains prime in both the first 2 and second 3 siphon conduits for operation, transport, or storage. System flow control valve 1 operation permits automatic siphoning and precision control of start, stop, restart and variable flow for rapid, repeated and safe operations without further priming. The improved siphon pump system offers expanded applications in the controlled transfer of liquids.

FIG. 9 illustrates a siphon pump system having an improved system flow control valve apparatus 40 for priming and the precision transfer of liquids, including an anti-backflow valve 39 in the first siphon conduit 2 inlet to prevent liquid from returning to the supply source for prime retention. The system flow control valve apparatus 40 is arranged between the first 2 and second 3 siphon conduits for automatic siphoning, pumping, priming, and control of start, stop, restart, and variable siphon flow. The apparatus 40 includes a three-way valve body having an upper body inlet conduit for valve stem assembly 41 access and travel, a lower body outlet conduit inline with the upper body inlet for valve stem assembly 41 travel and communicating with the inlet of the second siphon conduit 3 for siphon flow, and a body conduit perpendicular to the upper and lower body conduits, and communicating with the outlet of the first siphon conduit 2 for siphon flow. A perforated valve cap 42 having a threaded central opening for accepting and guiding the valve stem assembly 41 is positioned at the inlet of the upper body conduit. The valve stem assembly 41 comprises a shaft threaded at the upper end for connection to optional actuator devices, such as a handle, and engagement of the threaded central opening in the valve cap 42 for rotary control; an upper valve section 43 to prevent entry of air and aid priming; and a lower valve section 44 to control rate of siphon flow and aid priming. Removal of the valve cap 42 will permit alternate means to actuate the valve stem assembly 41. The system flow control valve apparatus 40 also permits pumping of liquids above the supply source by repeated plunging of the valve stem assembly 41 via manual, mechanical, electro-mechanical, pneumatic, or other means of actuation.

To begin operation, the system is primed by upwardly dis-engaging the valve stem assembly 41 from the valve cap 42 and plunging the valve stem assembly 41 until siphon flow is established. The valve stem assembly 41 is then re-engaged with the valve cap 42 to control rate of siphon flow by rotating the valve stem assembly 41 to position the lower valve section 44 for desired flow or stoppage; the upper valve section 43 prevents entry of air. Inclusion of an anti-backflow valve in the first siphon conduit 2 inlet in combination with the anti-backflow valve 4 at the second siphon conduit 3 outlet permits priming, and full-system retention of prime for automatic restart of siphon flow without additional priming. Prime retention provided by combination of anti-backflow valves and the improved system flow control valve apparatus 40 allows the operator to shut off siphon flow for transport, storage, or intermittent operation, and remain ready for the next operation. The precision siphon pump system has energy efficient applications in food production and water management, and as a controllable siphon intake for hydropower generation.

FIG. 10 illustrates a siphon pump system in combination with FIG. 9 and having an improved metering chamber 7 for dispensing a measured quantity of liquid above the supply source. Siphon flow begins at the anti-backflow valve 39 within a liquid supply source and through the first siphon conduit 2, the metering chamber 7, an improved system flow control valve apparatus 40, a second siphon conduit 3, and an anti-backflow valve 4 extending to an elevation below the liquid supply source sufficient to establish siphon flow.

The metering chamber 7 is positioned within the first siphon conduit 2 and above the liquid supply source for holding and dispensing a measured quantity of liquid, and includes an upper inlet communicating with the first siphon conduit 2 outlet for siphon flow entry to fill the metering chamber 7, an upper outlet communicating with the second siphon conduit 3 inlet for system siphon flow to exit the metering chamber 7, a lower outlet for dispensing above the supply source from the metering chamber 7, a flow control valve 48 communicating with the lower outlet of the metering chamber 7 for regulating metering chamber flow and priming the system, and an anti-backflow valve 8 communicating with the lower outlet via a flow control valve 48 for automatically dispensing from the metering chamber 7 when the upper valve section 43 of the improved system flow control valve apparatus 40 is open.

An improved system flow control valve apparatus 40 is arranged between the first 2 and second 3 siphon conduits for priming the conduits and metering chamber 7, admitting air for automatically dispensing from the metering chamber 7, and system control of start, stop, restart, variable siphon flow, and automatic siphoning. The improved system flow control valve apparatus 40 includes a three-way valve body having an upper valve body inlet conduit for admitting air and valve stem assembly 41 access and travel, a lower valve body outlet conduit inline with the upper valve body inlet for valve stem assembly 41 travel and communicating with the inlet of the second siphon conduit 3 for siphon flow, and a mid valve body conduit perpendicular to the upper and lower valve body conduits communicating with the outlet of the first siphon conduit 2 for siphon flow from the metering chamber 7 and alternately admitting air in the opposite direction for dispensing. A perforated valve cap 42 is located at the inlet of the upper valve body conduit and having a threaded central opening for engaging and guiding the valve stem assembly 41, and admitting air through the perforated valve cap 42 for dispensing. The valve stem is threaded at the upper extremity for actuator connectivity and engaging the valve cap 42, and includes an upper valve section 43 to control air admittance and aid priming, and a lower valve section 44 to control siphon flow and also aid priming. Selective positioning of the valve stem assembly 41 maintains air admittance separate from siphon flow to prevent siphon collapse, and controls siphon start, stop, restart, variable siphon flow, and automatic siphoning.

Priming is an initial operation followed by cycles of dispensing and purging. Priming requires upwardly disengaging the valve stem assembly 41 from the perforated valve cap 42 and plunging the valve stem assembly 41 until siphon flow is established, then downwardly re-engaging the valve stem assembly 41 with the valve cap 42 while the metering chamber 7 and siphon system are filling. Once filled and siphon flow is continuous, rotation of the valve stem assembly 41 will position the valve sections to stop siphon flow, dispense, or purge to restore system siphon flow. Dispensing from the metering chamber 7 is controlled by rotation of the valve stem assembly 41 to open the upper valve body conduit with upper valve section 43 to admit air for dispensing via the mid valve body conduit and metering chamber 7 upper outlet in a direction opposite to normal siphon flow, while simultaneously closing the lower valve body conduit with lower valve section 44 will stop siphon flow to retain prime for the next operation of purging. Purging of entrained air introduced during dispensing requires rotation of the valve stem assembly 41 to close the upper valve body conduit with valve section 43 to stop air admittance and dispensing, while simultaneous opening the lower valve body conduit with lower valve section 44 to automatically start siphon flow to purge the system of entrained air and self-prime the system for the next dispense-purge cycle. Stoppage of the system involves rotation of the valve stem assembly 41 to close the upper valve body conduit with upper valve section 43, and also close the lower valve body conduit with lower valve section 44, while retaining full-system prime for future dispense-purge cycles. Successful dispense-purge cycles depend upon the volume of liquid in the second siphon conduit 3 sufficiently adequate to completely purge entrained air and establish system siphon flow. Optionally, the valve cap 42 may be disengaged to operate the improved system flow control valve apparatus 40 by alternate means and or in a linear mode. Applications efficiently provide a supply source for food production and water supplies, and supply elevated pumped storage ponds which contribute to hydropower generation.

FIG. 11 illustrates a siphon pump system in combination with FIG. 10 and including an improved automatic regulating chamber 49 to control sustained periodic dispensing from the metering chamber 7. The primary function is energy-free actuation of the improved system flow control valve apparatus 40 for dispense-purge cycles. Elements associated with the process include a regulating chamber 50 having a flow control valve 51, a float linkage assembly 52 connected to the valve stem assembly 41, and a conduit 53 connecting to the metering chamber 7 flow control valve 48, an anti-backflow valve 8, and a metering chamber control valve 48. The valve cap 42 is removed for actuation control to allow linear travel of the valve stem assembly 41, which is connected to the automatic regulating chamber linkage 52.

Timing for each dispense-purge cycle is regulated by adjusting flow control valve 48 to release contents of the metering chamber 7 to fill the regulating chamber 50, and adjusting flow control valve 51 to release contents of the regulating chamber 50 within an adequate period of time to purge and restore siphon flow to prevent siphon collapse. Once the system is primed, vertical movement of the valve stem assembly 41 actuated by the float linkage 52 will position the upper 43 and lower 44 valve sections for dispensing and purging. Dispensing from the metering chamber 7 is controlled by downward movement of the valve stem assembly 41 actuated by the float linkage 52 to open the upper valve section 43 to admit air for dispensing. Air enters the mid-valve body conduit and through the metering chamber 7 upper outlet in a direction opposite to normal siphon flow. Simultaneously, the lower valve body conduit is closed via lower valve section 44 to stop siphon flow and retain prime for subsequent purging. Entrained air introduced during dispensing requires purging with upward movement of the valve stem assembly 41 via the float linkage 52 to close the upper valve section 43 to stop air admittance and dispensing. Simultaneous opening the lower valve section 44 to automatically start siphon flow will purge the system of entrained air and prepare the system for the next dispense-purge cycle. System stoppage involves positioning the valve stem assembly 41 to close the upper 43 and lower 44 valve sections via closure of the automatic regulation chamber 50 outlet valve 51 to maintain full-system prime for future dispense-purge cycles.

These operations complete one dispense-purge cycle; repeated cycles automatically continue to dispense a measured quantity of liquid above the supply source from the metering chamber 7 without the aid of any powered device, and alternately release a larger measure of siphon flow below the supply source from the second siphon conduit 3 outlet. Successful dispense-purge cycles depend upon the volume of liquid in the second siphon conduit 3 adequate to completely purge air and establish system siphon flow for subsequent dispensing. Applications are the same for the metering siphon pump system, but adds the special feature of energy-free self-sustained repeated dispensing above the supply source.

FIG. 12 illustrates a siphon pump system in combination with FIG. 9, and includes a turbine 54 having an arrangement of blades fixed on a shaft 55 to rotate within a cylindrical chamber 56 positioned above the supply source in the first siphon conduit 2 for connection to mechanical or electrical hydropower facilities. The amount hydropower generated is determined by the rotational speed of the turbine 54, which is controlled by the rate of siphon flow and regulated by the improved system flow control valve apparatus 40 for automatic siphoning, priming, start, stop, restart, and variable flow. Retention of full-system prime permits immediate restart after shut down for maintenance or other reasons. The improved system flow control valve apparatus 40 and turbine 54 can be located up to an elevation of 25 feet, safely above and at a distance from the supply source for operation, maintenance and protection from flooding. Scalable applications of the turbine siphon pump system for hydropower generation are not restricted to dam locations, but any supply source accessible by siphon technology with minimal impact.

What is claimed is:

1. A closable siphon pump system with single-point valve control featuring an improved system flow control valve apparatus to prime, pump, and regulate siphon flow, and terminal anti-backflow valves to maintain system prime to transfer liquids from a supply source via siphoning over an elevation in an uninterrupted stream to a point below said supply source above or within a destination; to forcibly pump liquids from said supply source to said point above or below said supply source and above or within said destination; and to forcibly prime said closable siphon pump system to establish system siphon flow without further priming after an initial prime, said closable siphon pump system comprising: a) a prior art siphon pump system comprising: (1) a first siphon conduit extending upward from an inlet of said first siphon conduit submerged within a liquid supply source to an outlet of said first siphon conduit communicating with an inlet of said improved system flow control valve apparatus disposed above said liquid supply source for upward movement of system siphon flow; (2) a second siphon conduit extending downward from an outlet of said improved system flow control valve apparatus disposed above said liquid supply source and communicating with an inlet of said second siphon conduit for downward movement of system siphon flow to an outlet of said second siphon conduit disposed below said liquid supply source and within or above said destination, and said second siphon conduit of greater length than said first siphon conduit sufficient to establish system siphon flow by force of gravity; (3) an anti-backflow valve communicating with said outlet of said second siphon conduit to establish one-way directional system siphon flow from said inlet of said first siphon conduit upward through said improved system flow control valve apparatus and downward through said second siphon conduit to exit said outlet of said second siphon conduit disposed below said liquid supply source within or above said destination; to prevent reverse flow into said second siphon conduit; and to provide an automatically closable second siphon conduit upon closure of said improved system flow control valve apparatus to retain prime for system readiness without further priming after said initial prime; b) wherein the improvement comprises: (4) an anti-backflow valve communicating with said inlet of said first siphon conduit to establish one-way directional system siphon flow from said inlet of said first siphon conduit upward through said improved system flow control valve apparatus and downward through said second siphon conduit to exit said outlet of said second siphon conduit disposed below said liquid supply source within or above said destination; to prevent return of liquid to said liquid supply source; and to provide an automatically closable first siphon conduit upon closure of said improved system flow control valve apparatus to retain prime for system readiness without further priming after said initial prime; and (5) the improved system flow control valve apparatus for single-point valve control communicating with said outlet of said first siphon conduit and said inlet of said second siphon conduit disposed above said liquid supply source to control start, stop, restart and vary system siphon flow through said first siphon conduit, said improved system flow control valve apparatus, and said second siphon conduit; to provide immediate control to transfer liquids from said liquid supply source via siphoning over said elevation in a selectively variable stream to exit below the supply source at said point above or within said destination; to control retention of system prime by means of said terminal anti-backflow valves responding automatically to closure of said improved system flow control valve apparatus without further priming after said initial prime; to forcibly prime said first siphon conduit, said improved system flow control valve apparatus, and said second siphon conduit to establish system siphon flow; and forcibly pump liquid above or below said liquid supply source to said point above or within said destination; said improved system flow control valve apparatus comprising: (a) a three-way valve body consisting of an upper valve body conduit and a side valve body conduit forming a valve controllable siphon flow path to enter said side valve body conduit from said outlet of said first siphon conduit and exit an outlet of a lower valve body conduit communicating with said inlet of said second siphon conduit; said upper valve body conduit and said lower valve body conduit forming an inline path for a valve stem assembly; and said upper valve body conduit externally threaded at an upper extremity to mate a removable cap, and disposed to accept said valve stem assembly; (b) said removable cap internally threaded to mate with said externally threaded upper extremity of said upper valve body conduit; an internally threaded central aperture to engage said valve stem assembly to control priming, pumping, and siphon flow; and said internally threaded central aperture encircled by perforations for air exchange during priming; and (c) said valve stem assembly comprising a shaft consisting of an upper threaded portion and a lower unthreaded portion, wherein said lower unthreaded portion is of a smaller diameter than said upper threaded portion; an upper air control valve seal and a lower siphon control valve seal affixed to said lower unthreaded portion; said upper threaded portion to engage a handle or other means of actuation at an upper extremity, and to engage an internally threaded central aperture of an internally threaded removable cap to control system siphon flow by rotating said valve stem assembly to position said upper air control valve seal within said upper valve body conduit to prevent entry of air into said siphon flow path, and position said lower siphon control valve seal in said siphon flow path to start, vary, stop, and restart siphon flow through said siphon flow path; and said upper threaded portion disengaged from said internally threaded removable cap by upward rotation until said lower unthreaded portion of said shaft passes freely through said internally threaded central aperture of said internally threaded removable cap to guide said valve stem assembly linearly to prime said closable siphon pump system by reciprocating said valve stem assembly to establish system siphon flow.

2. A closable metering siphon pump system with single-point valve control featuring an improved system flow control valve apparatus to prime, dispense, purge and regulate siphon flow; an improved metering chamber apparatus to periodically dispense metered quantities of liquid above a supply source; and terminal anti-backflow valves to maintain system prime to ensure periodic dispensing of liquid and recovery of system prime during purging of introduced air for subsequent dispensing without further priming after an initial prime, said closable metering siphon pump system comprising: a) wherein a prior art metering siphon pump comprises: (1) a first siphon conduit extending upward from an inlet of the first siphon conduit being submerged within a liquid supply source to an outlet of said first siphon conduit communicating with an upper inlet of said improved metering chamber apparatus disposed above said liquid supply source for upward movement of system siphon flow; (2) a second siphon conduit extending downward from an outlet of said improved system flow control valve apparatus disposed above said liquid supply source and communicating with an inlet of said second siphon conduit for downward movement of system siphon flow to an outlet of said second siphon conduit disposed below said liquid supply source and within or above a destination, and said second siphon conduit of greater length than said first siphon conduit sufficient to establish system siphon flow by force of gravity; (3) an anti-backflow valve communicating with said inlet of said first siphon conduit to establish one-way directional system siphon flow from said inlet of said first siphon conduit upward through said improved metering chamber apparatus and said improved system flow control valve apparatus, and downward through said second siphon conduit to exit said outlet of said second siphon conduit disposed below said liquid supply source and within or above said destination to prevent reverse flow into said second siphon conduit and to provide an automatically closable first siphon conduit upon closure of said improved system flow control valve apparatus to retain prime for system readiness without further priming after said initial prime; (4) an anti-backflow valve communicating with said outlet of said second siphon conduit to establish one-way directional system siphon flow from said inlet of said first siphon conduit upward through said improved metering chamber apparatus, said improved system flow control valve apparatus, and downward through said second siphon conduit to exit said outlet of said second siphon conduit disposed below said liquid supply source and within or above said destination to prevent return of liquid to said liquid supply source and to provide an automatically closable second siphon conduit upon closure of said improved system flow control valve apparatus to retain system prime for system readiness without further priming after said initial prime; b) wherein the improvement comprises: (5) the improved system flow control valve apparatus for single-point valve control communicating with an outlet of said improved metering chamber apparatus and said inlet of said second siphon conduit disposed above said liquid supply source to control start, stop, and restart the system siphon flow for periodic dispensing of metered quantities of liquid from said improved metering chamber apparatus, and subsequent purging of introduced air to recover system prime for further dispensing episodes; to forcibly prime said first siphon conduit, said improved metering chamber apparatus, said improved system flow control valve apparatus, and said second siphon conduit to maintain system prime upon closure of terminal anti-backflow valves responding automatically to closure of said improved system flow control valve apparatus, and without further priming after the initial prime, said improved system flow control valve apparatus comprising: (a) a three-way valve body consisting of an upper valve body conduit and a side valve body conduit forming a valve controllable siphon flow path to enter said side valve body conduit from said outlet of said first siphon conduit and exit an outlet of a lower valve body conduit communicating with said inlet of said second siphon conduit; said upper valve body conduit and said lower valve body conduit forming an inline path for a valve stem assembly; and said upper valve body conduit externally threaded at an upper extremity to mate with a removable cap, and disposed to accept said valve stem assembly; (b) said valve stem assembly comprising a shaft consisting of an upper threaded portion and a lower unthreaded portion, wherein said lower unthreaded portion is of a smaller diameter than said upper threaded portion; an upper air control valve seal and a lower siphon control valve seal affixed to said lower unthreaded portion; said upper threaded portion to engage a handle or other means of actuation at an upper extremity, and to engage an internally threaded central aperture of an internally threaded portion of said removable cap to control system siphon flow by rotating said valve stem assembly to position said upper air control valve seal within said upper valve body conduit to prevent entry of air into said siphon flow path, and position said lower siphon control valve seal in said siphon flow path to start, vary, stop, and restart siphon flow through said siphon flow path; and said upper threaded portion disengaged from said internally threaded portion of said removable cap by upward rotation until said lower unthreaded portion of said shaft passes freely through said internally threaded portion of said internally threaded removable cap to guide said valve stem assembly linearly to prime said closable siphon pump system by reciprocating said valve stem assembly to establish system siphon flow; and (c) said removable cap internally threaded to mate with said externally threaded upper extremity of said upper valve body conduit; said internally threaded portion comprising an internally threaded central aperture to engage said valve stem assembly to control priming and siphon flow; and said internally threaded central aperture encircled by perforations for air exchange during priming; (6) the improved metering chamber apparatus disposed above said liquid supply source to periodically dispense a quantity of liquid and permit recovery of system prime for subsequent periodic dispensing, and comprising an enclosed chamber having an upper inlet communicating with said first siphon conduit outlet for siphon flow to enter said improved metering chamber apparatus: an upper outlet communicating with said improved system flow control apparatus for air flow to enter said improved metering chamber apparatus via said perforations in said cap, said upper valve body conduit, and said side valve body conduit of said improved system flow control apparatus during a periodic dispensing episode, and for siphon flow to exit said improved metering chamber in an opposite direction through said upper outlet during a separate purging episode to recover system prime; and a lower outlet communicating with a flow control valve and an anti-backflow valve to periodically dispense a quantity of liquid above said liquid supply source; c) wherein the self-regulating metering siphon pump system further comprises: an improved self-regulating chamber apparatus for single-point valve control to actuate said improved system flow control valve apparatus to regulate periodic gravity-fed dispensing above said liquid supply source from said improved metering chamber apparatus, and purge introduced air to recover system prime for subsequent dispensing without further priming after the initial prime, said self-regulating chamber apparatus comprising: (1) a regulating chamber disposed above said liquid supply source and below said improved metering chamber apparatus to receive gravity dispensed flow from said improved metering chamber apparatus via said lower outlet communicating with said anti-backflow valve, said conduit, and said two-way flow control valve; an upper access aperture for a float assembly to respond to dispensed flow to control linkage for dispensing and purging episodes; and a lower aperture disposing a two-way flow control valve for regulating gravity flow from said regulating chamber to effect timing of periodic dispensing and purging episodes; (2) a float assembly disposed within said regulating chamber to respond to liquid level of dispensed flow to control linkage communicating with said float assembly and said valve stem disposing said air control valve seal and said system flow control valve seal to control system siphon flow, and timing of periodic dispensing and purging episodes; and (3) a linkage assembly communicating with said float assembly disposed within said regulating chamber and said valve stem assembly disposed within said improved system flow control valve apparatus for actuating said valve stem assembly to admit air for dispensing by opening said air control valve seal and closing said system flow control valve seal, and to permit system siphon flow to purge air and prime the system for the next dispense-purge cycle by closing said air control valve seal and opening said system flow control valve seal.

3. A closable turbine siphon pump system with single-point valve control featuring a siphon turbine apparatus to interface hydropower facilities for energy production, an improved system flow control valve apparatus to prime and regulate siphon flow and thereby siphon turbine speed, and terminal anti-backflow valves to maintain system prime without further priming after an initial prime, said turbine siphon pump system comprising: a) wherein a prior art siphon turbine comprises: (1) a first siphon conduit extending upward from an inlet submerged within an upstream water source to an outlet communicating with an inlet of the siphon turbine apparatus disposed above and distant from said upstream water source for upward movement of siphon flow for turbine rotation; (2) a second siphon conduit extending downward from an outlet of said siphon turbine apparatus to an outlet of the second siphon conduit disposed downstream for downward movement of system siphon flow for rotation of said siphon turbine apparatus within the turbine siphon pump system; b) wherein the improvement comprises: (3) an anti-backflow valve communicating with the inlet of said first siphon conduit to establish one-way directional system siphon flow from said inlet of said first siphon conduit submerged in said upstream water source upward through said siphon turbine apparatus, through said improved system flow control valve apparatus, and downward through said second siphon conduit to exit said outlet of said second siphon conduit disposed within or above a downstream destination to prevent return of liquid within said turbine siphon pump system to said upstream water source and to provide an automatically closable first siphon conduit upon closure of said improved system flow control valve apparatus to retain system prime for system readiness without further priming after an initial prime; (4) an anti-backflow valve communicating with the outlet of said second siphon conduit to establish one-way directional system siphon flow from said inlet of said first siphon conduit upward through said siphon turbine apparatus, through said improved system flow control valve apparatus, and downward through said second siphon conduit to exit said outlet of said second siphon conduit disposed within or above the downstream destination; to prevent reverse flow into said second siphon conduit; and to provide an automatically closable second siphon conduit upon closure of said improved system flow control valve apparatus to retain prime for system readiness without further priming after the initial prime; (5) the improved system flow control valve apparatus communicating with the outlet of said siphon turbine apparatus and the inlet of said second siphon conduit for single-point control of said siphon turbine apparatus to provide rotational energy for variable hydropower generation; said improved system flow control valve apparatus disposed above and distant from said upstream water source to control start, stop, restart and variable siphon flow to transfer water from said upstream water source over an elevation through said first siphon conduit, said siphon turbine apparatus, said improved system flow control valve apparatus, and said second siphon conduit and to exit downstream below said upstream water source at a point above or within the downstream destination; to maintain system prime upon closure of terminal anti-backflow valves responding automatically to closure of said improved system flow control valve apparatus, and without further priming after the initial prime; and to forcibly prime said first siphon conduit, said siphon turbine apparatus, said improved system flow control valve apparatus, and said second siphon conduit to establish system siphon flow, said improved system flow control valve apparatus comprising: (a) a three-way valve body consisting of an upper valve body conduit and a side valve body conduit forming a valve controllable siphon flow path to enter said side valve body conduit from said outlet of said first siphon conduit and exit an outlet of a lower valve body conduit communicating with said inlet of said second siphon conduit; said upper valve body conduit and said lower valve body conduit forming an inline path for a valve stem assembly; and said upper valve body conduit externally threaded at an upper extremity to mate with a removable cap, and disposed to accept said valve stem assembly; (b) said removable cap internally threaded to mate with said externally threaded upper extremity of said upper valve body conduit; an internally threaded central aperture to engage said valve stem assembly to control priming and siphon flow; and said internally threaded central aperture encircled by perforations for air exchange during priming; (c) said valve stem assembly comprising a shaft consisting of an upper threaded portion and a lower unthreaded portion, wherein said lower unthreaded portion is of a smaller diameter than said upper threaded portion; an upper air control valve seal and a lower siphon control valve seal affixed to said lower unthreaded portion; said upper threaded portion to engage a handle or other means of actuation at an upper extremity, and to engage the internally threaded central aperture of the internally threaded removable cap to control system siphon flow by rotating said valve stem assembly to position said upper air control valve seal within said upper valve body conduit to prevent entry of air into said siphon flow path, and position said lower siphon control valve seal in said siphon flow path to start, vary, stop, and restart siphon flow through said siphon flow path; and said upper threaded portion disengaged from said internally threaded removable cap by upward rotation until said lower unthreaded portion of said shaft passes freely through said internally threaded central aperture of said internally threaded removable cap to guide said valve stem assembly linearly to prime said closable siphon pump system by reciprocating said valve stem assembly to establish system siphon flow (6) the siphon turbine apparatus communicating with said outlet of said first siphon conduit and said improved system flow control apparatus and disposed in said path of siphon flow, above and distant from said water supply, and sealable to exclude penetration of air and retain prime during priming and operation of said closable turbine siphon pump system by means of said improved system flow control valve apparatus; the terminal anti-backflow valves responding automatically to operation of said improved system flow control valve apparatus to regulate flow and maintain system prime without further priming after the initial prime, said siphon turbine apparatus comprising: (a) a rigid cylindrical tube having an open distal aperture communicating with an inlet of said improved system flow control apparatus including an open framework having a smooth-bore central aperture to permit a shaft to rotate within; a closed proximal terminus having a smooth-bore central aperture to permit said shaft to rotate within, and sealed to prevent leakage; and a proximal aperture on a side of said rigid cylindrical tube communicating with said first siphon conduit outlet for incoming siphon flow; (b) said shaft disposed within said rigid cylindrical tube and secured in said proximal smooth-bore central aperture and said distal smooth-bore central aperture to rotate freely powered by a helical blade affixed to said shaft, and extending from said distal terminus through said proximal terminus and to a point beyond said proximal terminus for attachment to hydropower facilities; and (c) the helical blade approximating the diameter of said rigid cylindrical tube and affixed to said rigid cylindrical shaft within a distance between said proximal terminus and said distal terminus to rotate in response to system siphon flow regulated by said improved system flow control valve apparatus.

* * * * *